US006920654B2

(12) United States Patent
Noguchi et al.

(10) Patent No.: US 6,920,654 B2
(45) Date of Patent: Jul. 26, 2005

(54) WATER SHOWER APPARATUS

(75) Inventors: Masao Noguchi, Nara (JP); Akihiko Nakashima, Nara (JP); Shigeru Shirai, Nara (JP); Masaaki Kawaguri, Osaka (JP); Satoshi Furuta, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 410 days.

(21) Appl. No.: 09/894,704

(22) Filed: Jun. 28, 2001

(65) Prior Publication Data

US 2002/0040500 A1 Apr. 11, 2002

(30) Foreign Application Priority Data

Jun. 29, 2000 (JP) ..... 2000-196068

(51) Int. Cl.[7] ..... A47K 3/28
(52) U.S. Cl. ..... 4/601; 4/615
(58) Field of Search ..... 4/567, 568, 570, 4/597, 601, 605, 615

(56) References Cited

U.S. PATENT DOCUMENTS

| | | | | |
|---|---|---|---|---|
| 661,351 A | * | 11/1900 | Manning | 4/597 |
| 3,827,088 A | * | 8/1974 | Arnold et al. | 4/570 |
| 6,195,814 B1 | * | 3/2001 | Yoshida et al. | 4/601 |

FOREIGN PATENT DOCUMENTS

| | | |
|---|---|---|
| JP | 08-280567 | 10/1996 |
| JP | 08-280568 | 10/1996 |
| JP | 10-028656 | 2/1998 |

OTHER PUBLICATIONS

Sanyo web site information, dated Apr. 10, 2000 w/partial English translation, 7 pgs.

* cited by examiner

*Primary Examiner*—Robert M. Fetsuga
(74) *Attorney, Agent, or Firm*—RatnerPrestia

(57) ABSTRACT

The water shower apparatus according to the present invention is constructed in a way to produce cold air intercepting screen having warming effects around the bather. In this water shower apparatus, the shower sprayed from the wide-angle spray nozzle of the shower system forms a shower curtain. That water shower of thin cold air intercepting screen is sprayed toward about the neck and the shoulders to the flanks of the bather. And, the shower curtain formed this way wraps about the horizontal face under the neck of the bather, the vertical face about in the vertical direction on the left and the right sides of the bather's body, and the front face centering on the lower half portion of the bather's body. This enables to intercept cold air from outside and enclose the hot air inside. Production of "cold feeling" at the time of entry of the bather into the chilled bathroom can be prevented. The entire body of the bather can be warmed with bathing.

8 Claims, 16 Drawing Sheets

WATER SHOWER APPARATUS

FIELD OF THE INVENTION

The present invention relates to a water shower apparatus for taking a hot water shower bath.

BACKGROUND OF THE INVENTION

A conventional water shower apparatus is indicated in the Japanese Laid-Open Patent No. 10-28656. FIG. 16 indicates an external side view of this conventional water shower apparatus 1. This conventional water shower apparatus 1 is installed in a bathroom 2 or a special shower room inside or outside a house. In this conventional water shower apparatus 1, a plurality of spray nozzles 4 are installed in either the nozzle arm 5 or part of the water shower apparatus 1 at regular intervals. Those plurality of spray nozzles 4 spray water on the bather 3 taking a hot water shower bath in a seated position, with a certain expanse (namely, with a fully conical spray pattern and a spray angle in the range of approximately 30 to 50), toward the front face and part of the back face of the bather 3. And the hot water shower sprayed from the plurality of spray nozzles 4 is sprayed in concave and convex shapes at some intervals in the front, rear, left and right parts on the lower half of the body of the bather 3.

However, in general households, especially in the bathroom during a winter season or in an intermediate season, the room temperature is low and the humidity is high. For that reason, the bathroom is very much chilled. Moreover, even if the bathing is made one after another, the bathroom is liable to get cold immediately if the bathing is interrupted for some time. Naturally, the bather, who gets into the bathroom in naked state, becomes sensitive and feels the low temperature more strongly. Therefore, in a conventional water shower apparatus, for some time until the body of the bather gets warm with bathing, the sprayed air current produced with the respective spray nozzles disposed at certain intervals stirs the cold air in the bathroom. That cold air wraps the bather's body from top and bottom, front and rear, and from left and right as a draft in a complicated way. For that reason, this cold air gives a feeling of discomfort even to persons of sound health. Moreover, this cold air gives a particularly strong feeling of discomfort to aged people, people of delicate constitution, people requiring protection, etc.

Furthermore, the fine particles of the sprayed hot water shower splash on part of the bather's face or hair, because the spray nozzles are disposed at a high position higher than the bather's neck and also because the shower has a certain expanse. For that reason, a feeling of discomfort is produced even with taking of hot water shower bath.

Still more, while the portions of human body where one feels the action and effects of hot water bath most strongly are shoulders, waist, buttocks and feet generally, the touch of shower to the areas of feet, buttocks, side shoulders and flanks in particular is rather poor with the conventional type of shower apparatus, and this was the cause of poor showering effects especially at the initial period of bathing.

Yet more, the shower apparatus including nozzle arm has large dimensions of width and depth. For that reason, the washing space becomes very small when the shower apparatus is installed in a narrow bathroom. As a result, the shower apparatus gives a feeling of oppression or malaise to the bather.

SUMMARY OF THE INVENTION

The shower apparatus according to the present invention comprises a cold air intercepting screen formed around the shower bather.

Preferably, the water shower apparatus according to the present invention comprises a shower apparatus body and a plurality of spray nozzles installed movably on said body, in which at least one of the plurality of spray nozzles forms a screen intercepting the cold air.

With this arrangement, the cold air from outside is shut off, and the hot air inside is enclosed. Therefore, a warming action by direct contact of the shower with the skin and a sealing action of hot air enclosed by the shower curtain are produced, and the entire body of the bather can be warmed with those actions. As a result, production of "cold feeling" at the time of entry of the bather into the chilled bathroom can be prevented.

DETAILED DESCRIPTION OF THE INVENTION

Figure 1:
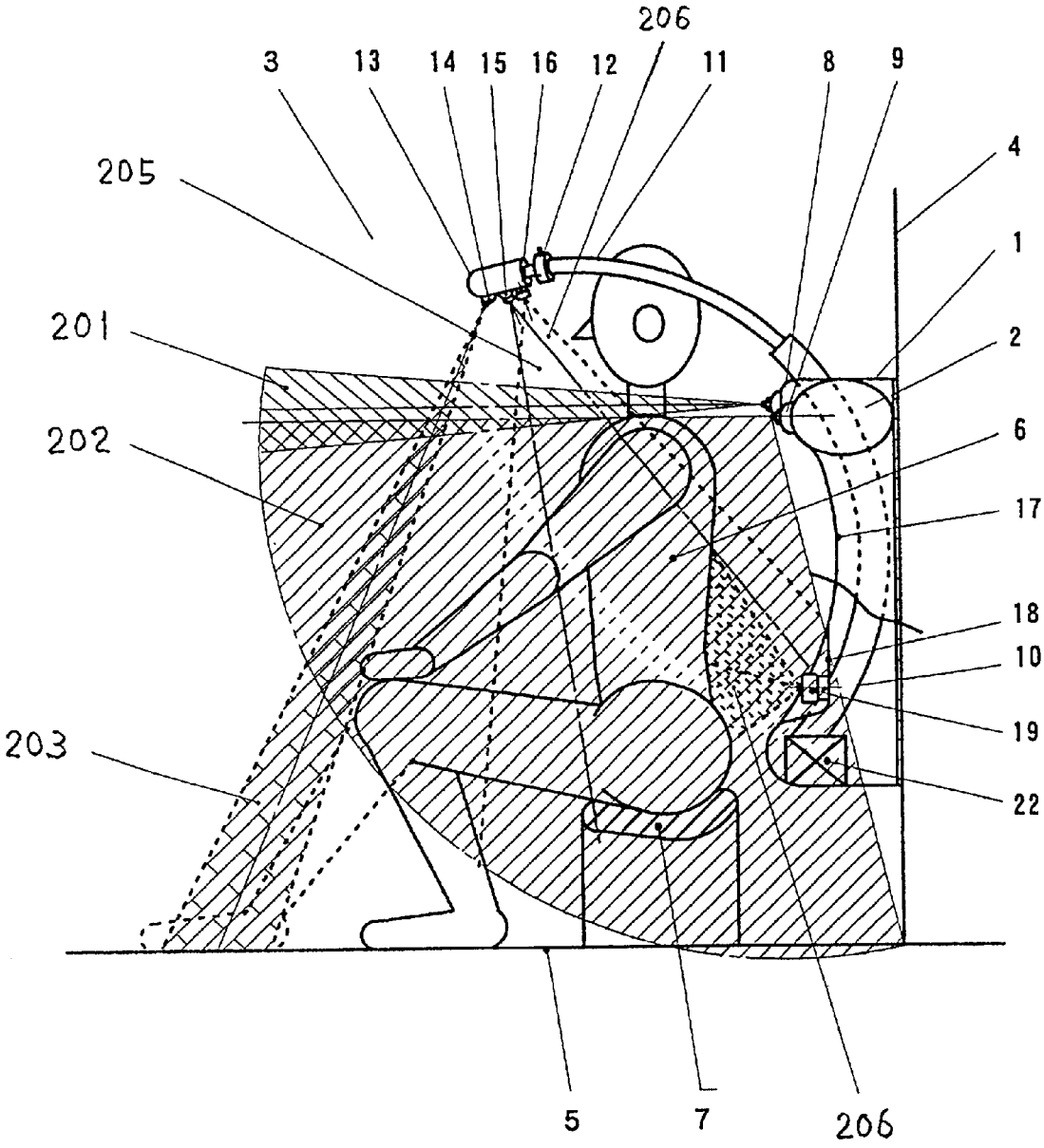
FIG. 1 is a side view of the water shower apparatus in Embodiment 1 of the present invention.

The water shower apparatus of an embodiment of the present invention comprises a cold air intercepting screen formed around the shower bather.

Preferably, the water shower apparatus according to the present invention comprises a shower apparatus body and a plurality of spray nozzles installed movably on the body, wherein at least one of the plurality of spray nozzles forms a screen intercepting the cold air.

Preferably, the cold air intercepting screen is formed by covering about around the neck of the shower bather.

Preferably, the cold air intercepting screen is formed by covering the area from about the shoulders to about the flanks of the shower bather, producing warming effects on both the left and right sides of the shower bather.

Preferably, the water shower apparatus according to the present invention comprises a spray nozzle of a type forming cold air intercepting screen, the spray nozzle of a type forming cold air intercepting screen spray water on the bather's body at a wide angle, to thereby produce the warming effects.

Preferably, the water shower apparatus according to the present invention comprises a spray nozzle of a type forming cold air intercepting screen, the spray nozzle of a type forming cold air intercepting screen having fan-shaped spray nozzles for spraying shower water on the bather's body at a wide spraying angle in a flat shape.

Preferably, the water shower apparatus according to the present invention comprises a first spray nozzle of a type forming cold air intercepting screen and a second spray nozzle of a type forming cold air intercepting screen, wherein the first spray nozzle forms a first cold air intercepting screen covering the area around the neck, and the second spray nozzle forms a second cold air intercepting screen covering the left and right sides of the shower bather.

With the above construction, the cold air from outside is shut off, and the hot air inside is enclosed. Therefore, a warming action by direct contact of the shower with the skin and a sealing action of hot air enclosed by the shower curtain are produced, and the entire body of the bather can be warmed with those actions. As a result, production of "cold feeling" at the time of entry of the bather into the chilled bathroom can be prevented.

The water shower apparatus of an embodiment of the present invention comprises a construction for producing a cold air intercepting screen having warming effects around the shower bather. In this water shower apparatus, the shower sprayed from wide-angle spray nozzles of the water shower apparatus forms a shower curtain. The water shower of that thin cold air intercepting screen is sprayed toward about the neck part and the area from the shoulders to the flanks of the bather. And the formed shower curtain wraps up about the horizontal face under the neck of the bather's body, the vertical face in about the up-down direction on both the left and right sides of the bather's body, and the front part of the body centering on the bottom half of the bather's body. As a result the cold air from outside is shut off, while the hot air inside is sealed. Therefore, (a) a warming action by direct contact of the shower with the skin, (b) a warming action for warming the entire body of the bather as the shower flows down through the neck and other parts of the his body, and (c) a sealing action of hot air enclosed by the shower curtain are produced, and the entire body of the bather can be warmed with those actions.

That shower is sprayed around the neck of the bather, to cover the area around the neck and form a cold air intercepting screen having warming effects. A hot water shower curtain formed with a regulated thin cold air intercepting screen comes in contact with the portion under the neck and the portion under the rear part of the neck of the bather. For that reason, (a) a cold air intercepting action for intercepting the cold air current flowing down from above around the neck, (b) a hot air controlling action holding the hot air rising from below along the hot water shower curtain, and (c) a warming action for warming the rear part of the neck with hot water shower from a short distance, are produced. Moreover, the hot water flowing after touching the neck flows down from the scruff of the neck to the shoulders, the back, the check and to the lower half of the body. As a result, about the entire body of the bather is warmed. Thanks to this warming action, the body can be warmed faster. Namely, hot bathing is concentrated on the portions under the neck which are the most sensitive parts of the human body. For that reason, the bather who entered the chilled bathroom is protected against the "sense of cooling". "Sense of cooling" means a "sense of feeling cold" or a "sense of feeling coldness on one's skin". As a result, the shower bather can feel satisfaction basically. In addition, since the hot water shower is prevented from splashing on and wetting the hair, the face and the ears of the bather, the bather can enjoy comfortable and smart shower bathing.

Furthermore, the shower is sprayed on the bather's body from about the shoulders to about the flanks of the shower bather, forming a cool air intercepting screen having warming effects on both the left and right sides of his body. A hot water shower curtain consisting of cool air intercepting screen is generated in a way to cover the lower half of the bather's body from the back face on both sides. In addition, that hot water shower curtain is sprayed on the bather's body from the shoulders to the flanks of the shower bather. As a result, (a) a cold air intercepting effect for shutting off cold air current flowing in by turning around the left and right sides of the bather's body, (b) a hot air controlling action holding the hot air rising from both the left and right faces of the body by wrapping the left and right flanks of the body, (c) a warming action for warming the entire lower half of the bather from the shoulders to the flanks of the bather's body, and (d) a warming effect of hot water flowing down through the surface of the body, are produced, and the body is warmed more quickly by those actions.

The water shower apparatus of an embodiment of the present invention is provided with spray nozzles forming cold air intercepting screen. The spray nozzles forming cold air intercepting screen comprise wide-angle spray nozzles. Those wide-angle spray nozzles produce a shower having a wide spray angle, to form a cold air intercepting screen having warming effects. The wide-angle spray nozzles produce a shower of a wide spray angle. The spray nozzles are disposed in such a way that the shower touches the portion no higher than the neck, the area from the shoulders to the flanks and another part of the bather's body. This enables to form a cold air intercepting screen. Therefore, the bather obtains (a) a cold air intercepting action, (b) a hot air enclosing action, (c) a warming action by direct touch with the skin, and (d) a warming action by hot water flowing down through the surface of his body.

Preferably, the spray nozzles forming cold air intercepting screen comprise fan-shaped spray nozzles. The fan-shaped spray nozzles produce a shower having a wide spray angle and a flat spray shape, i.e. spray a shower in the form of a fan-shaped thin film. This enables to continuously form a hot water shower curtain having a large surface area, in the cold air intercepting area comprising the portion no higher than the neck, the area from the shoulders to the lower area and the private parts of the bather's body (namely, an area having about a triangle shape as seen from above the bather's head). This makes it possible to obtain a shower curtain having a wide surface area with a small number of nozzles. As a result, the action of intercepting the cold air current from around the body increases, and the action of enclosing the hot air inside also become stronger. This helps to further increase the warming effects.

Preferably, the spray nozzles forming cold air intercepting screen comprise a first spray nozzle forming cold air intercepting screen for covering the area around the neck and a second spray nozzle forming cold air intercepting screen for spraying at the left and right sides of the bather's body. The spray angle of the first spray nozzle is narrower than the spray angle of the second spray nozzle. This makes it possible to concentrate the hot water shower at the neck of the bather. For that reason, the hot water shower touches the body without loss. Moreover, part of the hot water shower flows from the scruff of the neck to the shoulders and behind the back, and another part flows to the flanks. This basically promotes the bathing effect of the hot water shower. Furthermore, the hot water shower sprayed from the second spray nozzle effectively touches the bather's body by concentrating widely from the portion around the shoulders to the lower half of the body. For that reason, the bathing effect by the hot water shower of both the first spray nozzle and the second spray nozzle can be further promoted.

Preferably, the spray pattern of said first spray nozzle is about horizontal, and the spray pattern of the second spray nozzle is about vertical. For that reason, the state of spraying of hot water shower curtain sprayed from the first spray nozzle and the second spray nozzle, as seen from above the bather's head, forms about the shape of a triangle pole with the wall face on which is mounted the shower apparatus body and the shape of the spray pattern of the second spray nozzle. Moreover, the hot water shower curtain sprayed from the first spray nozzle forms the shape of a top cover, forming a hot water shower curtain space area similar to about a triangle pole can. This reduces the portion of the body protruding from the shower curtain area. The main body of the water shower apparatus can be constructed in compact size narrower than the breadth of shoulders of the bather. Furthermore, the cold radiant heat radiated from the wall face on which is mounted the main body of the water shower apparatus is prevented from touching the bather's body by concentrating on his buttocks and feet. Still more, production of cold air current is prevented which is mixed from the cold floor of the wash place. Namely, the hot water shower curtain by the second spray nozzle covers the flanks from the upper half to the lower half of the bather's body, and a barrier of hot water shower curtain is also produced strongly toward the floor face of the washing area. This restricts production of unfavorable conditions such as cold radiant heat and cold air current, etc. As a result, production of "sense of cooling" to the bather is prevented. Therefore, the bather can enjoy comfortable and effective hot water shower.

Preferably, the spraying direction area of the second wide-angle spray nozzle is an area at least lower than the spraying area of the first spray nozzle. The arrangement of the second spray nozzle is controlled so that the extension line portion in the spraying direction area of the second spray nozzle is an area lower than the spraying pattern of the first spray nozzle. This prevents the hot water shower sprayed from the second wide-angle spray nozzles from splashing to the ears, the face and the hair of the bather. Moreover, a strong barrier by hot water shower curtain is produced toward the lower half portion of the bather's body and the floor face of the wash place. This helps to control mixing of cold air. Furthermore, the hot water shower touches the bather concentratedly and effectively. This enables the bather to enjoy comfortable hot water shower. Still more, with installation of three wide-angle spray nozzles only, it becomes possible to obtain energy-saving effects, in addition to the effects mentioned before.

Preferably, the first spray nozzle or the second spray nozzle have a plurality of nozzles. This makes it possible to obtain a hot water shower curtain of high density, with little broken portions. For that reason, the (a) cold air intercepting action for shutting off cold air current coming in from the surrounding area, and the (b) hot air enclosing action for sealing the hot air in the shower curtain also increase. This further increases the warming action exerted on the bather's body.

The water shower apparatus of an embodiment of the present invention is provided with a water shower apparatus body, a nozzle moving arm and a plurality of sprays nozzles. The water shower apparatus body is positioned behind the back of the bather. The nozzle moving arm, supported by the water shower apparatus body, moves the nozzles to a desired position. The plurality of spray nozzles produce showers having different spray patterns on the nozzle moving arm. Two nozzle moving arms disposed on the left and the right sides are installed in a way to freely get into and come out of the main body, by water pressure, electric motor, manual operation, etc. The plurality of nozzles are installed at the tip of the nozzle moving arms. The 2 nozzle moving arms are installed separately from the main body on the left and the right sides. The two nozzle moving arms are disposed in a way to face the front face of the shoulders and the chest, through the top part or about the flanks of the bather's shoulders. Hot water showers having different spray patterns are sprayed from the plurality of nozzles. Those plurality of hot water showers are sprayed on the shoulders, flanks, chest and abdomen portion, knees and feet of the bather from the front face either widely in a way to cover the entire areas or in concentrated way on specific portions. In addition, there is also a hot water shower curtain formed by said first spray nozzles and second spray nozzles. This enables to obtain comfortable and effective hot water shower bathing from the front and the rear sides of the bather's body.

Preferably, at the tip of the nozzle moving arm is installed a nozzle header having a plurality of spray nozzles. The respective spray nozzles produce showers having different spray patterns. A plurality of spray patterns discharged from a plurality of spray nozzles and a plurality of hot water showers having different spray angles are sprayed on the shoulders, flanks, chest and abdomen portion, knees and feet of the bather from the front face either widely in a way to cover the entire body areas or in concentrated way on specific portions. Moreover, a hot water shower curtain formed by the first wide-angle nozzles and the second wide-angle nozzles is combined with them. This enables to obtain comfortable and effective hot water shower bathing from the front and the rear sides of the bather's body.

Preferably, said nozzle header is installed rotatably around the arm axis. The nozzle header is disposed at either near the knees or the feet which are farthest from the shower apparatus body. For example, on the nozzle header are installed either (a) direct-jet type spray nozzles for spraying hot water shower straight like fire hose, or (b) slewing type spray nozzles for spraying hot water shower in a slewing shape having massaging action and effects in the area from the chest to the flanks and the abdomen by disposing spray nozzles of narrow spraying angle. In the shoulders area are disposed wide-angle spray nozzles for spraying hot water shower in a wide angle. Moreover, the rotation of the nozzle can be regulated so that the shower may touch the object part accurately. This enables to increase the feeling of hot bath on the entire surface of the bather's body which was difficult to warm, and activate the circulation of blood.

Preferably, the nozzle header has connecting means to be detachably connected to the nozzle arm. This makes it possible to adjust the spraying direction of the nozzles according to the breadth of the bather's shoulders. For that reason, a single unit of water shower apparatus can be used for bathers with different breadths of shoulders, according to the breadth of the bather's shoulders. Moreover, the bather can change the direction of the nozzle arm freely, to a desired direction for applying the hot water shower. This provides the bather with better satisfaction of hot water shower bathing. Furthermore, it also enables to perform repair work easily in case of clogging or other troubles of a plurality of nozzles provided on the nozzle header. Thus the maintenance work, etc. become easier.

Preferably, the nozzle moving header moves through a means of expansion from the main body of the water shower apparatus. The arm can be adjusted mainly for spraying the shower uniformly on the entire surface of the bather's body. Moreover, it becomes possible to store the nozzle header near or in the shower apparatus body, after the end of shower bathing. As a result, the shower system can be kept in a state without interference in a narrow bathroom or shower room.

Preferably, the nozzle moving arm has an articulation means installed at either the root or on the way of the arm of the water shower apparatus body. In this construction, the arm is movable. Rotation by moment of the nozzle moving arm becomes possible through indirect expansion means. This enables the nozzle tip to move. And, the shower can be sprayed uniformly on any desired part on the entire surface of the bather's body or in a concentrated way on some specific part. And, after the end of shower bathing, it becomes possible to store the nozzle header near the shower apparatus body or in the shower apparatus body As a result, the shower system can be kept in a state without interference in a narrow bathroom or shower room.

Preferably, the nozzle moving arm has a rotational joint means installed at either the root or on the way of the arm of the water shower apparatus body. The arm is movable. The nozzle moving arm can rotatably move the nozzle tip, through the rotational joint means. For example, in the case where the joint face is spherical, the arm can turn by approximately 360°. Moreover, in the case where the joint face is in contact with the arm at a certain inclination, the nozzle tip can rotatably move with a rotation. This enables the shower to be sprayed on any desired portion on the entire surface of the bather's body. And, after the end of shower bathing, it becomes possible to store the nozzle header near or in the shower apparatus body, after the end of shower bathing. As a result, the shower system can be kept in a state without interference in a narrow bathroom or shower room.

Preferably, the nozzle moving arm has no less than two of a rotational joint means, an articulation means or an expansion means installed at either the root or on the way of the arm of the water shower apparatus body. With this construction, the moving range of the arm becomes wider in three dimensions, making it possible for the shower to be sprayed in desired portions on the entire surface of the bather's body. Moreover, the nozzle can be moved in a way to bring the shower in contact with any desired area for bathers of different body sizes from small children to adults.

Preferably, the nozzle moving arm has a driving means for moving to desired position. The nozzle moving arm has a driving means utilizing hand-operated system, pressure system using fluid pressure such as water pressure, etc. and electric system (electric motor system, electromagnetic system, etc.). The nozzle tip can move to desired position by driving a rotational joint means, an articulation means or an expansion means. For that reason, the shower can be sprayed on any desired part on the entire surface of the bather's body. Moreover, the shower position can be changed easily during a shower bathing. Furthermore, after the end of shower bathing, the nozzle header can be stored easily near or in the shower apparatus body. As a result, the operability improves and the convenience increases in a narrow bathroom or shower room.

Preferably, the driving means drives with the acting force of a fluid pressure. This makes it possible for the nozzle moving arm to extend and contract linearly or curvedly, regardless if the bather is sitting or standing. For that reason, the bather can receive shower on the entire surface of his body. Therefore, the bather can obtain shower bathing in a relaxed way with no need of turning his body. Moreover, after the end of shower bathing, the inflow of the fluid stops, and the fluid accumulated in the arm is discharged. Furthermore, the arm can be stored easily near or in the shower apparatus body.

Preferably, the driving means has an electric motor. The driving means has a rotational driving means for rotationally driving with either a stepping motor provided with an internal gear rotating shaft biting with a feed rack, or other electric motor, or a stepping motor with different gear ratio, or other electric motor. This makes it possible to utilize energy-saving and low-voltage motors. It also enables to secure safety of the bather's body in the bathroom. Moreover, the reliability of the moving motion improves. Furthermore, since the moving length can be set in any desired position, the bather can enjoy shower bathing always in optimal position. He can also obtain best possible relaxation.

Preferably, the nozzle moving arm has a plurality of nozzle moving arms. A plurality of nozzle moving arms are disposed symmetrically around the neck, for example. This makes it possible to spray shower uniformly on both the left and the right sides of the shoulders, chest, abdomen, knees and feet respectively. Especially, it enables to obtain a feeling of hot bathing on the entire surface of the body. For that reason, the blood circulation is uniformly promoted. As a result, the bather can enjoy pleasant shower bathing.

Preferably, the spray angles of the third spray nozzle for spraying shower from the knees to the feet, the fourth spray nozzle for spraying from the chest and the abdomen, and the fifth spray nozzle for spraying toward the shoulders the nozzle moving arm respectively, of the plurality of spray nozzles disposed on the nozzle moving arm are given as follows: spray angle of third spray nozzle<spray angle of fourth spray nozzle<spray angle of fifth spray nozzle. The wider the spray angle from the spray nozzle, the finer the sprayed particles and the smaller the thermal capacity. For that reason, for spraying to portions of a short spraying distance, the spraying can be made in a state of high temperature without drop of temperature and in a wide surface area. Conversely, the thermal capacity is small at a long spraying distance. For that reason, there is a large drop of temperature during the spraying, and cold shower touches the bather's skin. On the other hand, the smaller the spray angle, the larger the sprayed particles and the larger the thermal capacity. For that reason, when spraying to portions of a long spraying distance, there is little drop of temperature due to heat dissipation during the spraying, and the shower can reach the bather's skin before the shower temperature drops. For that reason, said construction is optimal for a spray nozzle intended to portions with a long spraying distance. Therefore, the bather can enjoy a feeling of warm bathing uniformly, with the spraying angles of the respective nozzles which are given as follows: spray angle of third spray nozzle<spray angle of fourth spray nozzle<spray angle of fifth spray nozzle.

Preferably, the plurality of spray nozzles comprise spray nozzles having spray patterns of (a) direct-jet type spray nozzle or fan-shaped spray nozzle with small spray angle, (b) slewing type spray nozzle, and (c) wide-angle type spray nozzle. Of the various kinds of spray nozzle, the direct-jet spray nozzle or fan-shaped spray nozzle with small spray angle is optimal as spray nozzle for spraying to the feet and the knees with a long spraying distance from the arm, because it has a small spraying angle and a large particle size. The slewing type spray nozzle, which sprays shower from the spraying nozzle holes while slewing, is optimal as spray nozzle for spraying to the chest and the abdomen which are less sensitive to warm bathing or touch, because it has a slightly large spraying angle and a large contact pressure with the skin. Moreover, the wide-angle type spray nozzle is optimal as spray nozzle for spraying to the shoulders, etc. with a short spraying distance from the arm, because it has a small particle size and a wide spraying surface area.

Preferably, the nozzle moving arm is curved in the shape of an arc. Nozzle moving arms curved in the shape of an arc are disposed symmetrically. This enables a compact and simple form of the motion for moving to the front face of the bather's body. For that reason, this construction is rational as a form of installation in a narrow bathroom or shower room.

Preferably, the water shower apparatus body facing the back of the bather's body is provided with a front cover formed in a concave shape at least at a part, and spray nozzle disposed in said concave shaped front cover. The lower half portion of the main body is formed in a concave shape, by not simply narrowing that portion but along the portion curved in concave shape of the extension arm. This makes it possible to obtain a water shower system body of compact design. The sprayed hot water shower spreads to left and right with hot water shower spraying nozzles installed in the main body in concave shape. Hot water shower spreads to a wide range on the back face and around the waist of the bather. For that reason, the hot bathing action of the shower is promoted to provide comfortable shower bathing.

Preferably, the water shower apparatus of an embodiment of the present invention comprises spray nozzles for forming a cold air intercepting screen having warming effects around the shower bather, and spray nozzles for demonstrating hot bathing effects by spraying on the bather's body. The disposed wide-angle spray nozzle sprays a shower curtain consisting of a thin cold air intercepting screen toward around the neck and the shoulders to the flanks. That shower curtain wraps about the horizontal face around the neck, the vertical face in about the vertical direction on the left and the right sides of the body, and the front face of the body centering on the lower half portion of the bather's body. This shuts off cold air from outside and encloses the hot air inside the bather. This makes it possible to obtain (a) warming action of direct touch with the skin, (b) warming action for warming about the entire body of the bather while flowing down after touching the neck and other parts of the body, (c) sealing action of hot air enclosed by the shower curtain, and (d) warming action obtained by disposing spray nozzles intended for the entire surface of the body from shoulders to chest, abdomen and the waist on the back, etc. For that reason, increased rise of hot air and warming action in the shower curtain is obtained. As a result, the bather can enjoy optimal shower bathing.

Exemplary embodiments of the present invention will be explained with reference to drawings hereafter.

Exemplary Embodiment 1:

The water shower apparatus in Exemplary embodiment of the present invention is indicated in FIG. 1 to FIG. 9. This water shower apparatus comprises a main body 1 having an about T-shaped construction. The breadth at the top of the main body 1 is wider than the average breadth of shoulders of adult bathers, and protrudes in the shape of an arm 2. The breadth at the bottom of the main body 1 is narrower than the breadth of shoulders. The main body 1 is fixed to part of the wall face 4 of the bathroom 3, at a position slightly higher than the floor face 5, by means of metal fixture (not illustrated) or adhesive, etc. The bather 6 sits on a seat 7 disposed in front of the main body 1. In the center at the top of the main body 1 is provided a first wide-angle spray nozzle 8. The average breadth of shoulders of adult bathers was determined with reference to a Collection of measured data on human body of Japanese (issued by Human Life Engineering Research Center).

A plurality of second wide-angle spray nozzles 9 are provided at the left and right ends at the top of the main body 1. Two first nozzle arms 10 having curved cylinder are installed, inside the main body 1, on the left and the right sides of the center line of the main body 1. The two first nozzle arms 10 have a shape spreading wider in the upper part than in the lower part. Inside the first nozzle arm 10 is incorporated a second nozzle arm 11 working mainly by water pressure, etc. (or other motive force such as motor, manual operation, etc. may also be used). At the tip of the second nozzle arm 11 is provided a nozzle header 13 through a flexible joint 12. In the nozzle header 13 are installed, in this order from the downstream side of the hot water flow, a direct-jet spray nozzle 14, a slewing spray nozzle 15, and a third wide-angle spray nozzle 16.

A front cover 17 of the main body 1 is formed in a way to go along the curve of the first nozzle arm 10, and in the concavity 18 at the bottom of that front cover 17 are provided a plurality of third wide-angle spray nozzles 19. A combination faucet 20 with stop valve, flow regulating valve and switch valve is provided at the lower part outside or the lower part inside the main body 1. As combination faucet 20 with stop valve, flow regulating valve and switch valve, a thermostatic combination faucet is used, for example. The switch valve 21 for shower system, the first nozzle arm 10 and a plurality of spray nozzles, etc. are connected through a piping header 22.

Figure 2:
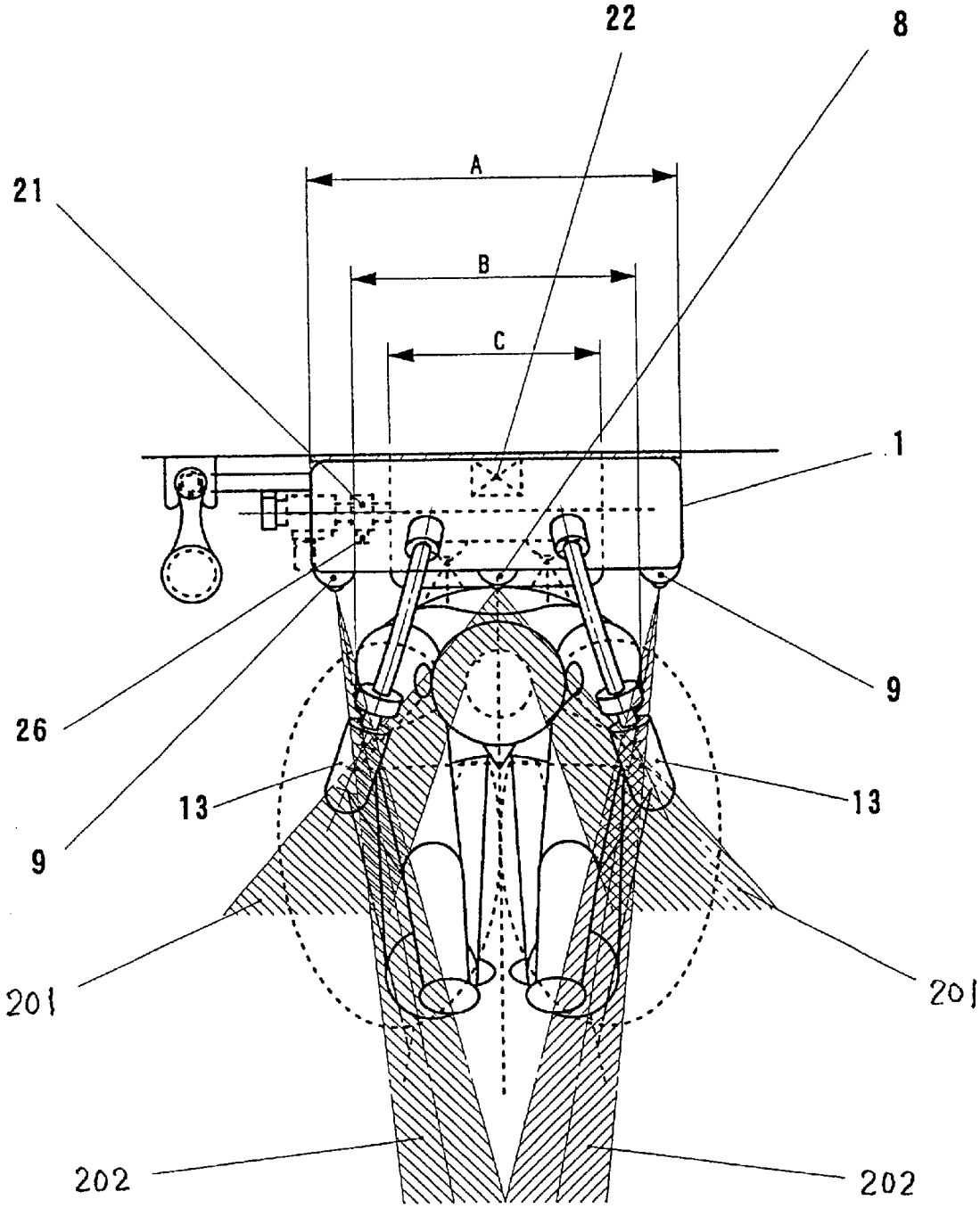
FIG. 2 is a plan view of the water shower apparatus in FIG. 1.

The cold water and the hot water supply sides of the combination faucet 20 are connected to the city water pipe (not illustrated) and a hot-water apparatus (end stop type/not illustrated). The combination faucet 20 has a city water flow regulating knob hereinafter referred to as city water valve knob) 23, a temperature regulating knob 24 and a selecting knob 25. The selecting knob 25 has the function of switching between a discharge port 27 and a discharge port for wash place 28. The switch valve 21 has a switch knob 26 of the hand shower unit 27A. In FIG. 1 and FIG. 2, the first wide-angle spray nozzle 8 sprays hot water, to form a first hot water shower curtain 201. Namely, the first wide-angle spray nozzle 8 sprays to the first spray area 201. The second wide-angle spray nozzle 9 sprays hot water, to form a second hot water shower curtain 202. Namely, the second wide-angle spray nozzle 9 sprays to the second spray area 202.

The direct-jet spray nozzle 14 sprays hot water, to form a third spray area 203. The slewing spray nozzle 15 sprays hot water, to form a fourth spray area 204. The third wide-angle spray nozzle 16 sprays hot water, to form a fifth spray area 205. The third wide-angle spray nozzle 19 sprays hot water, to form a sixth spray area 206.

The main body 1 of the water shower apparatus shall preferably incorporate at least the selecting valve 21. Combination faucets 20 of mechanical 2-valve system, thermostatic system, electronic system, etc. are installed in the bathroom 3 of general households. The hand shower unit 27 of the combination faucet 20 and the selecting valve 21 for the main body 1 of the water shower apparatus are piped by means of simplified piping (water supply type one-touch piping parts, etc./not illustrated, for example).

Next, explanation will be given on the motions and actions.

In the first place, set the temperature regulating knob 24 at the shower bathing temperature (approx. 40° C. for example). Next, switch the selecting knob 25 of the combination faucet 20 to the discharge port 27 side. Also switch the selecting knob 26 of the selecting valve 21 for the main body 1 of the water shower apparatus to the shower system side. Open the selecting knob 25, and the hot-water apparatus (not illustrated) connected to the combination faucet 20 will start working. Hot water and cold water are mixed from the city water pipes. Hot water at set temperature (approx. 40° C.) is supplied, through the piping header 22, the piping of the respective shower systems, etc., the first nozzle arm 10, the second nozzle arm 11, the flexible joint 12 and the nozzle header 13, to the respective first wide-angle spray nozzles 8, the respective second wide-angle spray nozzles 9, the direct-jet spray nozzle 14, the slewing spray nozzle 15 and the third wide-angle spray nozzles 16, 19, and is sprayed according to the spraying characteristics of the respective spray nozzles.

Figure 3:
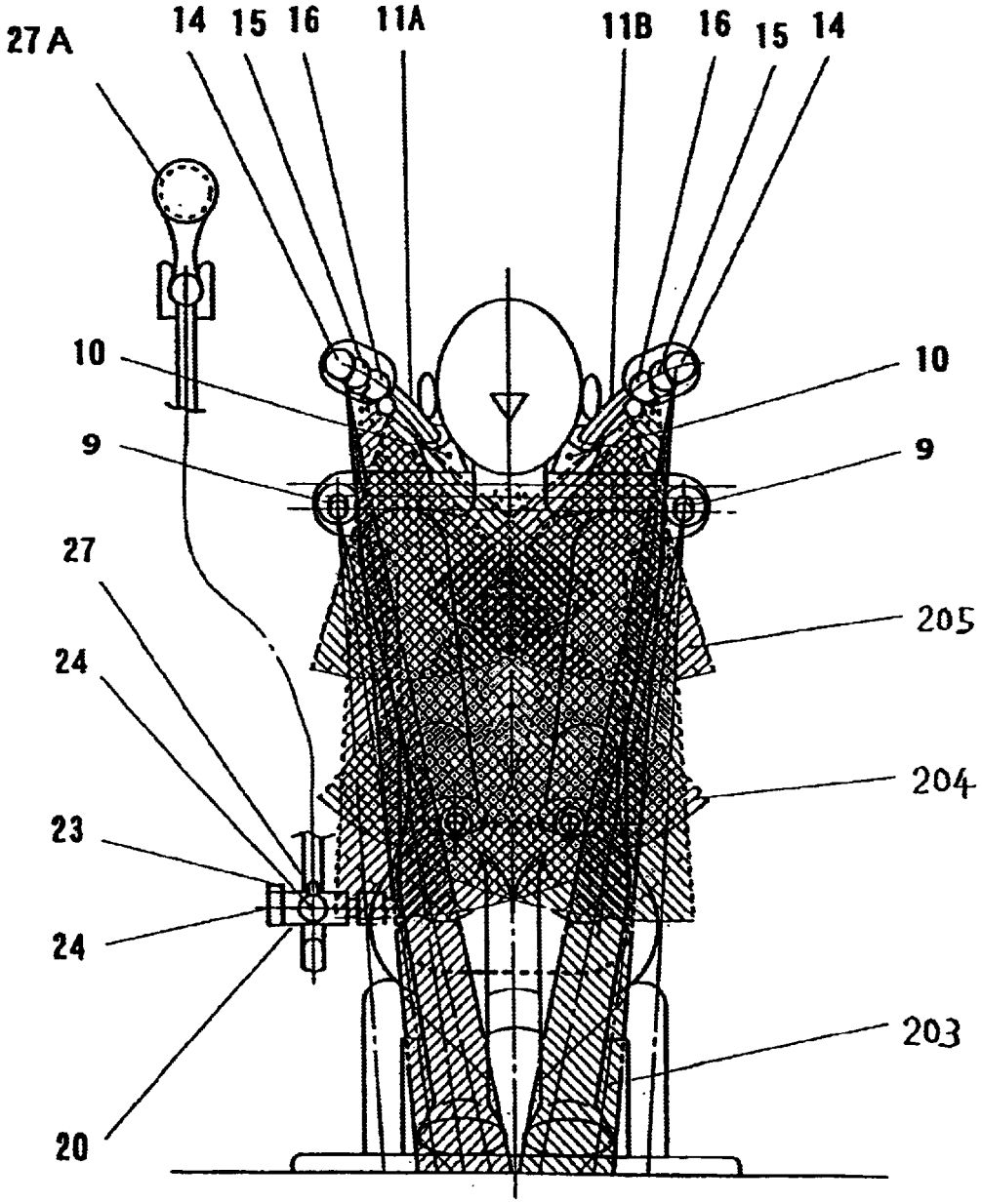
FIG. 3 is a front elevation of the water shower apparatus in FIG. 1.
Figure 4:
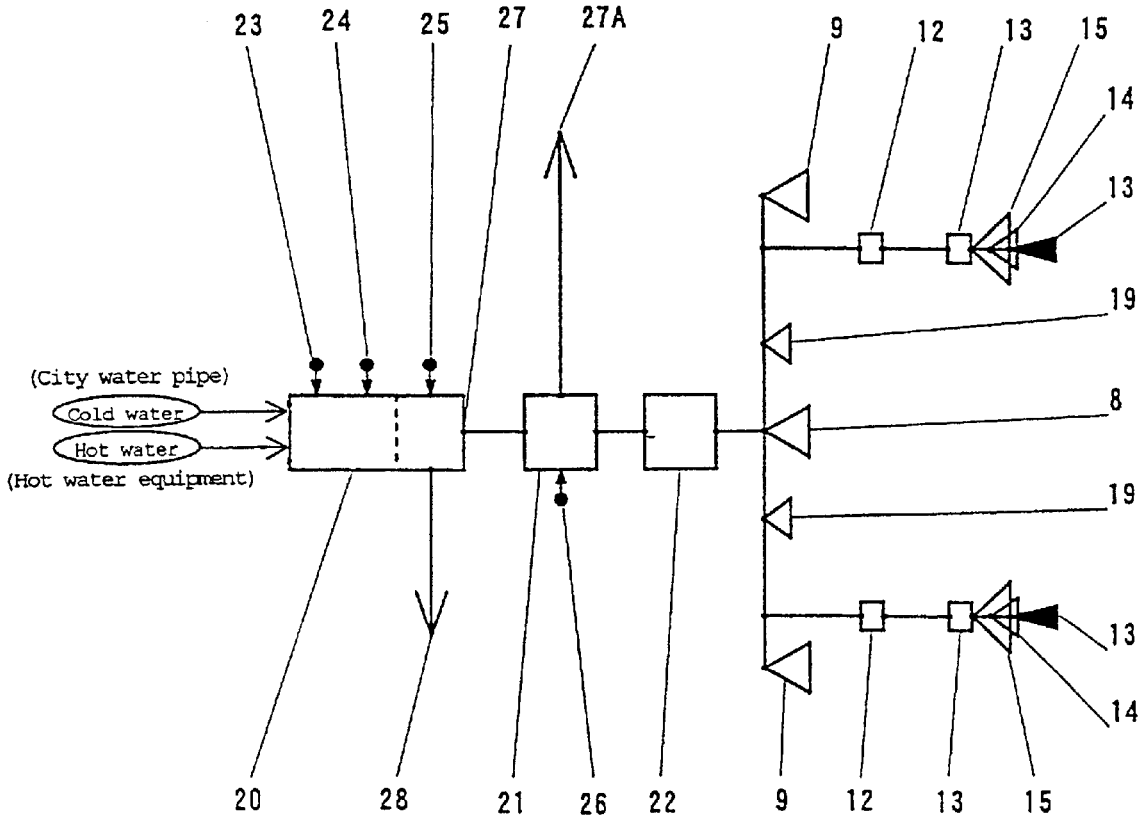
FIG. 4 is a hot water piping system drawing of the water shower apparatus in FIG. 1.
Figure 5:
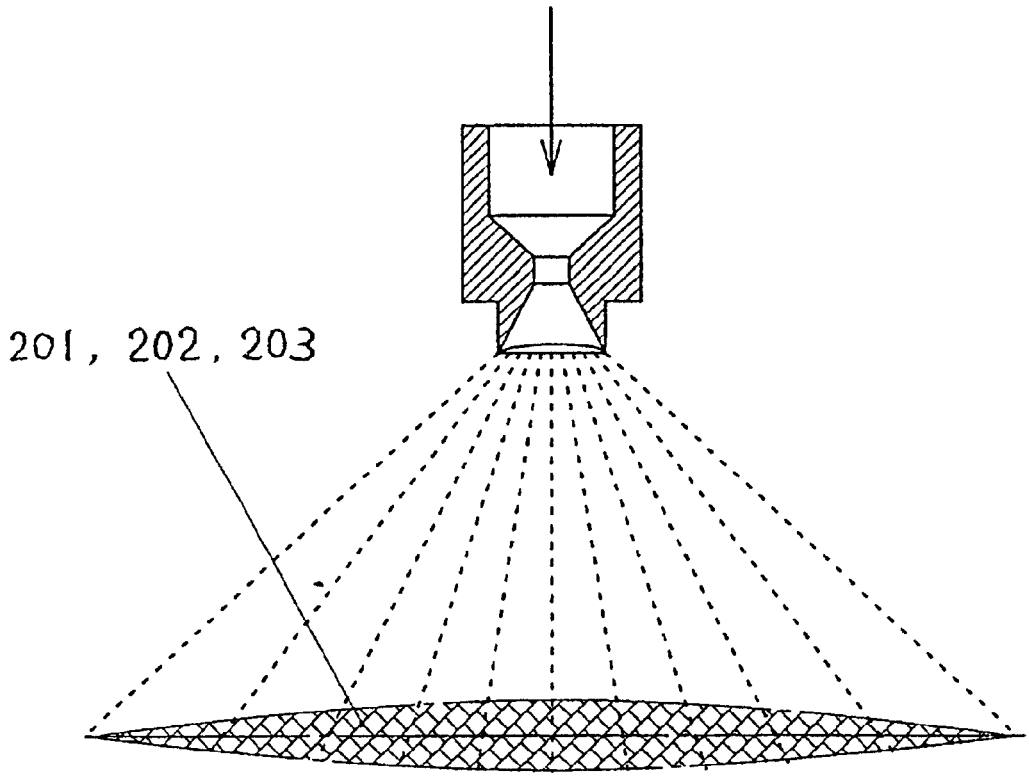
FIG. 5 is a sectional view of main part and a spray pattern drawing of the first wide-angle spray nozzle and the second wide-angle spray nozzle of the water shower apparatus in FIG. 1.

Namely, the first wide-angle spray nozzles 8 and the second wide-angle spray nozzles 9 spray with a fan-shaped spray pattern in the form of a thin film similar to the third spray area 203 In FIG. 5, to form a hot water shower curtain having a first spray area 201 and a second spray area 202. Moreover, the nozzle header 13 sprays with a spray pattern like that of a hot water shower in the shape of a water gun as the fourth spray area 204 in FIG. 6(*c*). The second slewing fan-shaped spray nozzle 15 (as shown In FIG. 3) sprays with a spray pattern in the shape of a whirl pulsating and swinging in the form of an empty cone like the fifth spray area 205 In FIG. 7. The third wide-angle spray nozzles 16, 19 spray with a wide-angle spray pattern in the shape of a cone like the sixth spray area 206 in FIG. 8.

Therefore, the bather 6 applies the first hot water shower curtain 201 like thin film, sprayed from the first wide-angle spray nozzle 8 disposed in a way to be controlled no higher than the neck of the bather, to the rear part of the neck and portions below that part of his body. For that reason, the first hot water shower curtain 201 about horizontal around the neck of the bather provides (a) a cold air intercepting action for intercepting cold air flowing in from the upper layer toward the bather's body, (b) a cold air intercepting action for intercepting cold radiation, and (c) a heat sealing action for keeping hot air current from being diffused by going up from lower layer to higher layer of the hot water shower curtain. In addition to such actions, it also provides (d) a warming action by direct contact with the skin centering on the rear part of the bather's neck from a short distance, and (e) a warming action for warming about the entire body of the bather as the hot water flowing down, after touching the neck, through the scruff of the neck, the shoulders, the back and part of the chest to the lower half portion of the body.

Namely, warm bathing is concentrated on the neck and the lower parts which are the most sensitive parts of the human body. This provides a barrier screen by intercepting mixing of cold air from above the neck, when the bather entered the chilled bathroom. For that reason, the shower bathing basically becomes satisfactory without giving a so-called "sense of cooling" to the bather. And yet, the hot water shower is prevented from splashing on the bather's hair, face and ears, protecting those parts against wetting. As a result, the shower system can provide comfortable and smart shower bathing.

Here, the spray from the second wide-angle spray nozzle 9 forms a fan-shaped second shower curtain 202 in the form of a thin film generated in a way to cover the lower half body, from the shoulders toward the flanks of the bather 6. Moreover, this shower system provides (a) a warming action by part of that second shower curtain 202 on the inside directly sprayed in a way to flow from the shoulders to the flanks and the entire lower half of the body of the bather 6, (b) a cold air intercepting action for intercepting cold air flowing in from left and right with the hot water shower curtain formed on the left and the right sides of the bather, (c) a cold air intercepting action for intercepting cold radiation from the surrounding walls, and (d) a heat sealing action for keeping hot air current from being diffused by going up from inside to higher layer through the gap on the left and the right sides of the bather's body.

Therefore, while the points of application of the second shower curtain 202 are different from those in the Exemplary Embodiment 1, hot water shower can be applied to a wide area from the shoulders to the flanks and the entire lower half of the bather's body in addition to the neck. For that reason, a barrier screen is formed to prevent mixing of cold air coming from the shoulders to the flanks and the entire lower half of the bather's body, when the bather 6 entered the chilled bathroom, as mentioned in the Exemplary Embodiment 1. For that reason, the so-called "sense of cooling" is prevented. In combination with the Exemplary Embodiment 1, this can basically make the shower bathing satisfactory. As a result, the shower system can provide comfortable and smart shower bathing.

Thanks to said effects of the first shower curtain 201 and the second shower curtain 202, bathers 6 such as aged person, person requiring personal care, person with cardiac disease, person handicapped in health, etc. can be protected against sudden states of danger not only during the winter time but also throughout the year. It further prevents production of a "sense of cooling" felt during winter and intermediate period even by healthy people.

On the other hand, by selecting fan-shaped nozzle for spraying shower in the shape of a fan for the first wide-angle spray nozzle 8 and the second wide-angle spray nozzle 9, it becomes possible to form the first shower curtain 201 and the second shower curtain 202 continuous in about a triangle shape, as seen from above the head of the bather 6, even when only three pieces of nozzle are used. These continuous hot water shower curtains 201 and 202 envelop the neck and the parts below the neck and the area of the lower half of the body of the bather 6 (especially, shoulders and flanks and the parts below them), to form a cold air intercepting space area for the private parts. This makes it possible for the hot water shower curtains 201 and 202 to spray shower in a way to cover and flow along the surface of the body from the neck to the lower portions of the bather 6. This prevents stirring of cold air in the bathroom by the sprayed air current produced with conventional spray nozzles. Moreover, the bather obtains a warming action by intercepting of cold air, sealing of internal heat and direct touch with his skin, and a warming action received in the course of flowing down of the shower. Therefore, the bather 6 is protected against a "sense of cooling". Furthermore, the bather can make a shower bathing by spraying hot water shower on the surface of his body, immediately after getting into the bathroom. For that reason, improved hot water shower bathing can be expected. In addition, there is no need of preheating the bathroom either.

Exemplary Embodiment 2:

The basic construction of the water shower apparatus in Exemplary Embodiment 2 of the present invention has the same partial construction as that of Exemplary Embodiment 1. The explanation of illustration of that identical part will be omitted. In this Exemplary Embodiment 2, the spray angle of the first wide-angle spray nozzle 8 is narrower than the spray angle of the second wide-angle spray nozzle 9, and wider than the spray angle of the second wide-angle spray nozzle 9. The nozzle specifications are set this way. Generally, the dimension of length in the direction of height from the breadth of the neck and the breadth of the shoulders and from the shoulders and the flanks to the knees of an average bather 6 is larger than the height of the water shower apparatus. Even in such state, a comfortable shower system can be obtained.

Explanation will be given on motions and actions.

As fan-shaped nozzle spraying in the form of a thin film like fan, the spray angle of the first wide-angle spray nozzle 8 is narrower than the spray angle of the second wide-angle spray nozzle 9. Or, the spray angle of the first wide-angle spray nozzle 8 is wider than the spray angle of the second wide-angle spray nozzle 9. This makes it possible for the hot water shower to touch the neck and the scruff of the neck in a concentrated way without loss. Moreover, part of that shower flows from the scruff of the neck to the shoulders and behind the back and other part further flows to the flanks. This basically improves hot water shower bathing. In addition to it, since the hot water shower concentrates on the neck part, the hot water shower does not splash to areas other than the area of the breadth of shoulders of the bather 6. Therefore, loss is prevented and saving of water can be expected.

On the other hand, the second wide-angle spray nozzle 9 can apply a hot water shower curtain (2) effectively by concentrating it widely from around the shoulders and the flanks to the lower half of the body of the bather 6. For that reason, said first wide-angle spray nozzle 8 and second wide-angle spray nozzle 9 provide synergic effects and further improve the bathing effects of the hot water shower.

Moreover, a fairly large gap is produced between the compact main body 1 and the bather 6, because of the second shower curtain 202 made by the second wide-angle spray nozzle 9 having a wide spraying angle. Although mixing of cold air from that gap is suspected, this mixing of cold air is controlled in greater part by the cold air intercepting barrier effect of the second shower curtain 202. Therefore, as described in the Exemplary Embodiment 1, the cold air is intercepted and the bather 6 is protected against a "sense of cooling". Furthermore, the bather can make a shower bathing by spraying hot water shower on the surface of his body, immediately after getting into the bathroom. For that reason, effective and healthy hot water shower bathing can be expected.

Exemplary Embodiment 3:

The basic construction of the water shower apparatus in Exemplary Embodiment 3 of the present invention has the same partial construction as that of Exemplary Embodiment 1. The explanation of illustration of that identical part will be omitted. In this Exemplary Embodiment, the spray pattern of the first wide-angle spray nozzle 8 is about horizontal, while the spray pattern of the second wide-angle spray nozzle 9 is about vertical. Moreover, the position of the 2 second wide-angle spray nozzles 9 is controlled so that their direction of spraying may be converged in the front direction.

Next, explanation will be given on motions and actions.

The state of spraying of the first shower curtain 201 and the second shower curtain 202 sprayed from the first wide-angle spray nozzle 8 and the second wide-angle spray nozzle 9 has a shape as described below. Namely, as seen from above the head of the bather 6, the shape of the spray pattern of the second wide-angle spray nozzle 9 against the wall face 4, on which is mounted the main body 1, is about that of a triangle pole. Moreover, on top of that pole, the first shower curtain 201 sprayed from the first wide-angle spray nozzle 8 takes the shape of a top cover, forming a hot water shower curtain space area similar to about a triangle pole can.

Especially, the main body 1 is constructed in a small compact size narrower than the breadth of shoulders of the bather 6. With the construction of this Exemplary Embodiment, the first shower curtain 201 made by the first wide-angle spray nozzle 8 and the second shower curtain 202 by the second wide-angle spray nozzle 9 cover the lower half of the bather's body and provide a strong cold air intercepting barrier of hot water shower curtain toward the floor face 5 of the wash place. Therefore, the cold radiant heat from the wall face 4 on which is mounted the main body 1 is prevented from concentrating on the buttocks and the feet of the bather 6 and, moreover, the cold radiant heat from the floor face 5 of the wash place is prevented from being irradiated on the bather 6, thus protecting the bather against cooling. In this way, the bather 6 is protected almost completely against a "sense of cooling". As a result, he can enjoy comfortable and effective hot water shower bathing.

Exemplary Embodiment 4:

The basic construction of the water shower apparatus in Exemplary Embodiment 4 of the present invention has the same partial construction as that of Exemplary Embodiment 1. The explanation of illustration of that identical part will be omitted. In this Exemplary Embodiment, the direction of spraying of the second wide-angle spray nozzle 9 is orthogonal to that of the first wide-angle spray nozzle 8. Moreover, the spray area of the second wide-angle spray nozzles 9 is positioned in an area lower than the spray area of the first wide-angle spray nozzle 8.

Next, explanation will be given on motions and actions.

Figure 8:
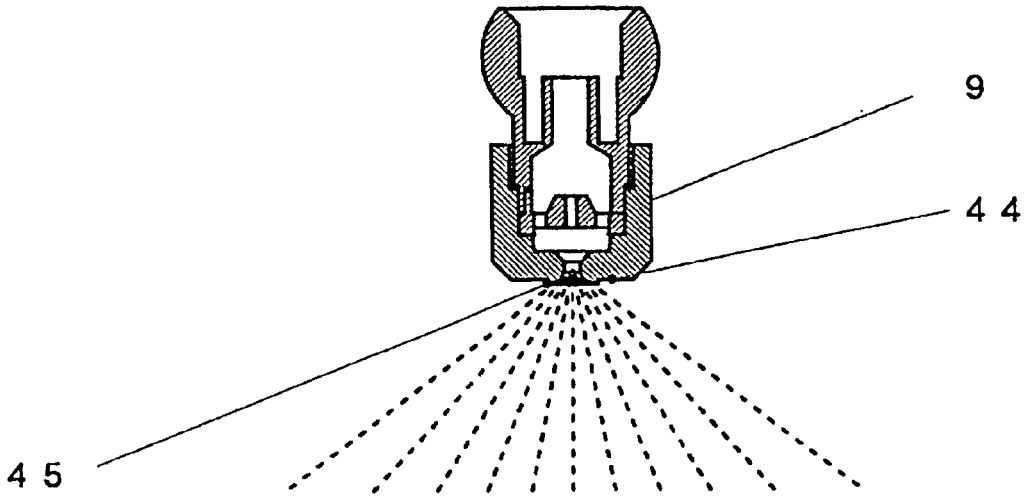
FIG. 8(*a*) is a sectional view of main part of a wide-angle spray nozzle of the water shower apparatus in FIG. 1, while FIG. 8(*b*) is a spray pattern drawing of a wide-angle spray nozzle.
Figure 8:
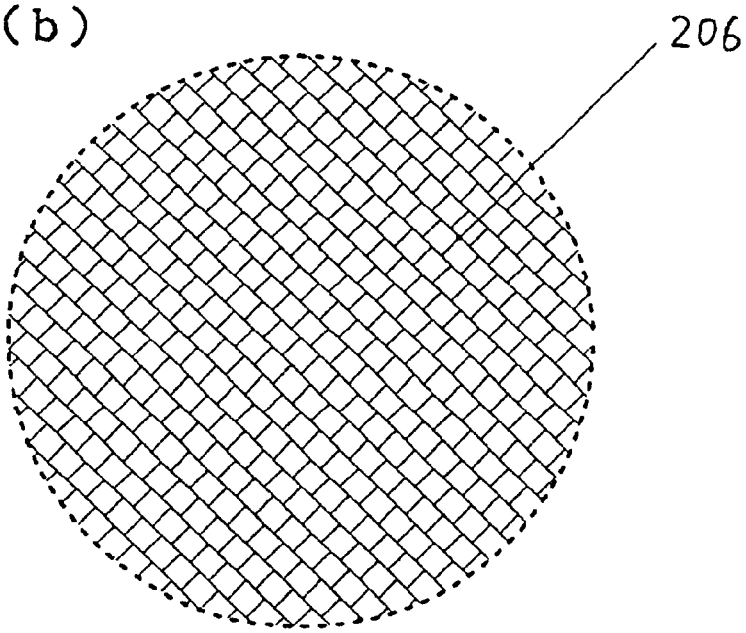
Figure 9:
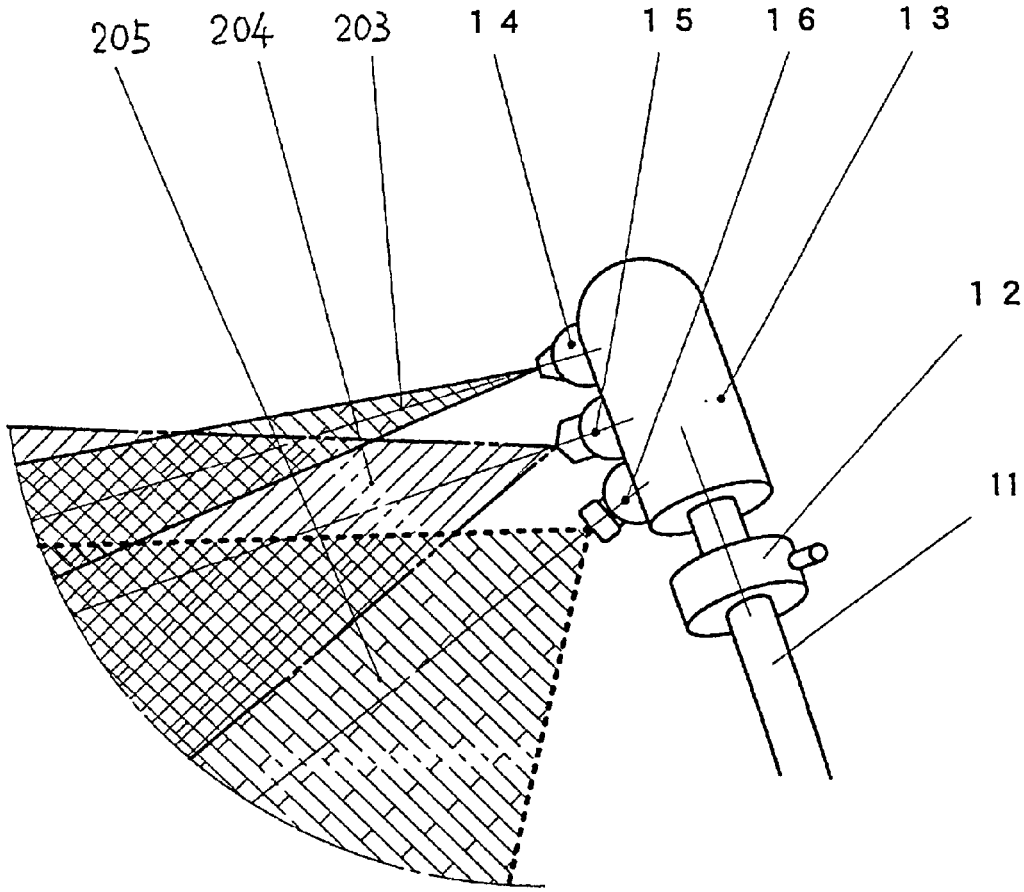
FIG. 9 is a perspective view showing the situation of disposition of nozzle arm, nozzle header, flexible joint and plurality of nozzles in the water shower apparatus in Embodiment 1 of the present invention.

The arrangement of the second wide-angle spray nozzles 9 is controlled so that the extension line portion in the spraying direction area of the second wide-angle spray nozzles 9 may be an area lower than the spraying pattern of the first wide-angle spray nozzles 8. This prevents, especially, the second hot water shower curtain 202, sprayed from the second wide-angle spray nozzles 9, from splashing to the ears, the face and the hair of the bather 6, in the same way as the action of the horizontal first hot water shower curtain 201 formed by the first wide-angle spray nozzles 8, thus providing protection against wetting. Moreover, a strong cold air intercepting barrier by the second hot water shower curtain 202 is produced, toward the lower half of the body of the bather 6 and the floor face 5 of the wash place, and this cold air intercepting barrier helps to control mixing of cold air. Furthermore, the hot water shower touches the bather 6 concentratedly and effectively. This enables to enjoy comfortable hot water shower. For that reason, the bather 6 can enjoy comfortable hot water shower bathing. Therefore, an energy-saving effect due to saving of water can be expected, in addition to said effects, even when only three pieces of wide-angle spray nozzles are installed. A plurality of spray nozzle showing a conical spray pattern as indicated in FIG. 8 may be disposed in vertical direction on the water shower apparatus body behind the left and the right sides of the bather's body, to thereby form a shower curtain. Also in this construction, the same cold air intercepting action and heat sealing action as above can be obtained. In this case, however, it is necessary to dispose a large number of nozzles.

On the other hand, one may think of forming a dense shower curtain, by disposing a plurality of wide-angle spray nozzles, on a conventional arm as indicated in Japanese Laid-Open Patent No. 10-28656. However, it is difficult to form a shower curtain with this method, because the main function of the spraying from the spray nozzles of the arm is warming action to the front face of the body and the knees. In this conventional method, the shower curtain is broken in some parts. The hot air leaks through such broken parts and, for that reason, this leak causes a drop of the cold air intercepting action and the hot air sealing action.

Exemplary Embodiment 5:

The basic construction of the water shower apparatus in Exemplary Embodiment 5 of the present invention has the same partial construction as that of Exemplary Embodiment 1. The explanation of illustration of that identical part will be omitted. In this Exemplary Embodiment, a plurality of spray nozzles are installed on the nozzle header 13, with spray patterns different from one another. Those plurality of spray nozzles spray hot water shower to the shoulders, chest, knees, etc. of the bather 6.

FIG. 5 to FIG. 8 indicate spray nozzles having spray patterns different from one another and spray patterns.

Figure 6:
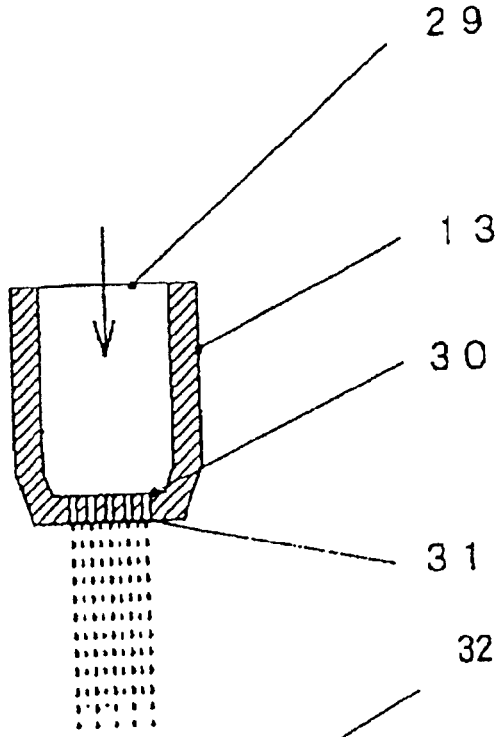
FIG. 6(*a*) a sectional view of main part of the third direct-jet spray nozzle of the water shower apparatus in FIG. 1, FIG. 6(*b*) is a spray pattern drawing of the third direct-jet spray nozzle, and FIG. 6(*c*) a another spray pattern drawing of the third direct-jet spray nozzle.
Figure 6:
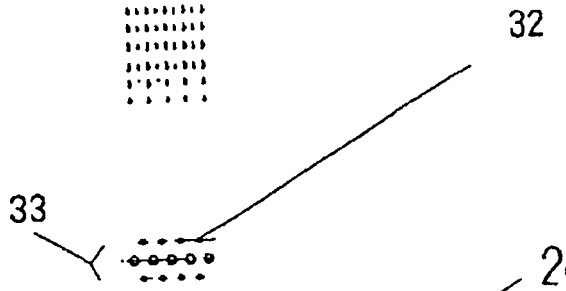
Figure 6:
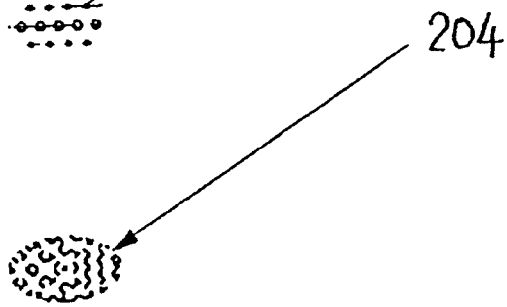

FIG. 5 indicates a wide-angle spray nozzle showing a wide-angle fan-shaped spray pattern, while FIG. 6 indicates a direct-jet spray nozzle. Inside the nozzle header 13 is provided an inflow port 29. On the spraying face 30 of that inflow port 29 are provided either a single or a plurality of small jet holes 31 of one same diameter (not illustrated). The bore size of the small jet hole 31 is different from the bore size of the small jet hole 32. A plurality of small jet holes with different bore sizes are disposed alternately and in parallel 33. Or a plurality of small jet holes with different bore sizes are disposed either at different pitches or in zigzag. Or, the spraying face 30 is either inclined or curved. In this way, the spraying direction and the spraying of the hot water shower can be changed.

Figure 7:
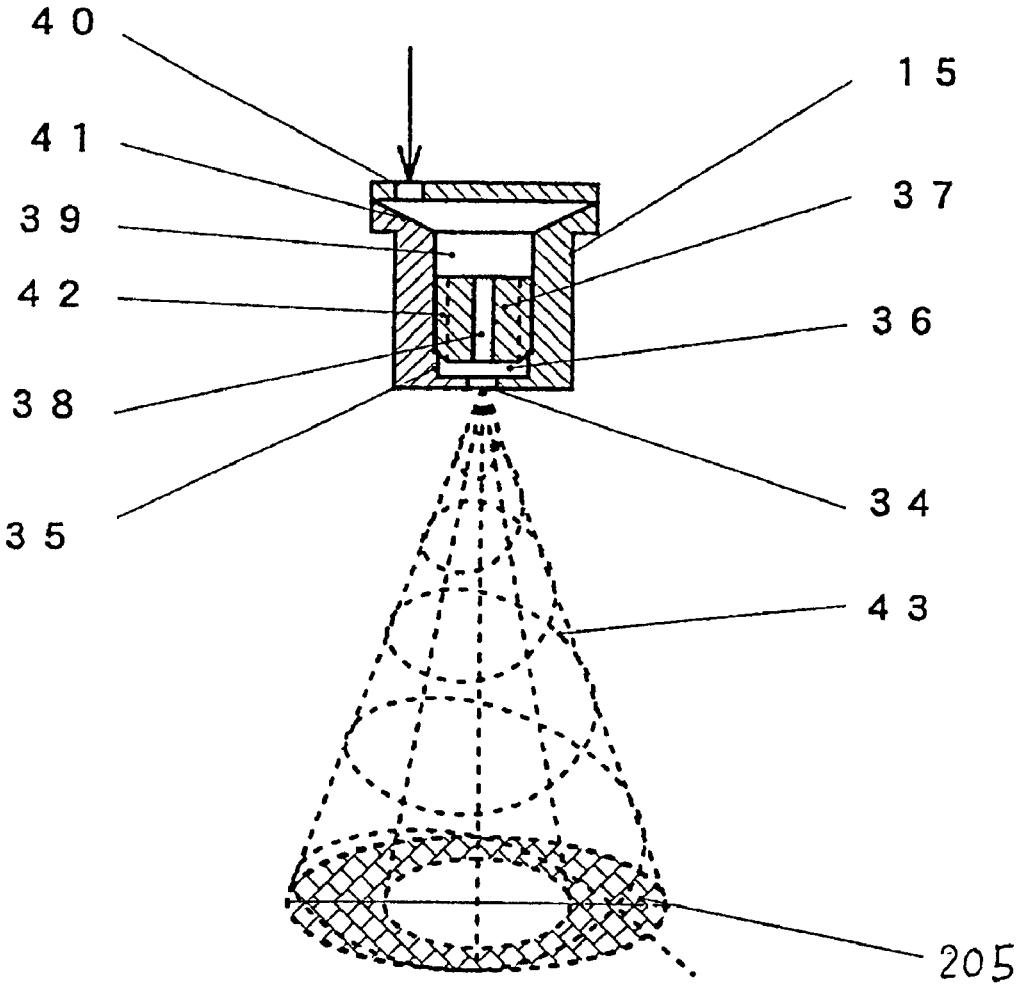
FIG. 7 is a sectional view of main part and a spray pattern drawing of a slewing nozzle of the water shower apparatus in FIG. 1.

It is also possible to use a construction in which the sprayed hot water shower is vibrated, shaken and swung by application of the principle of fluid control device, by changing the principle itself of the direct-jet spray nozzle 13. In FIG. 7, at the tip of the slewing type spray nozzle 15 is formed a spray hole 34, and on the spray hole 34 is constructed an inner wall 35. By keeping a certain distance 36, a core 37 for producing fine particles is mounted. At the center of this core 37 is drilled a straight hole 38 corresponding to the spray hole 34, and on the outer circumferential face of the core 37 are formed a plurality of inflow chambers 39. At the top of the core 37 is formed an inflow slewing port 40. As hot water gets into the inflow slewing port 40, it flows into the core 37 through the inclined part 41 and the inlet chamber 39, and part of that hot water volume passes through the straight hole 38. Moreover, the entire volume of the remaining hot water is given a rotational force vigorously in the slewing groove 42 on the outer circumference. That slewing flow of hot water and the straight flow from the straight hole 38 continuously produce spray particles in coarse and dense states by interaction in the process from the inner wall 35 to the spraying hole 34. These spray particles in coarse and dense states are sprayed out through the spraying hole 34, in a state of slewing spray pattern 205 (spray in the form of empty cone) in the state of slewing pulsation 43.

In FIG. 8, the second wide-angle spray nozzle 9 is a nozzle realized by applying the principle of nozzle indicated in the Japanese Laid-Open Patent No. 10-28656. The plane 44 at the tip of the nozzle has a shape spreading like a trumpet 45. That nozzle widens the spraying hole angle from approximately 50° to approximately 90°. The state of spraying at that time indicates a spraying hole pattern 206 in the form of a filled cone. This spraying hole pattern 206 becomes wider than that of a conventional system and the sprayed particle diameter becomes smaller. In addition, the spray indicates a state of pulsating spraying.

Next, explanation will be given on motions and actions.

Two nozzle arms 11 disposed on the left and the right sides get into and come out of the main body 1, or move, by water pressure, electric motor, manual operation, etc. Those two nozzle arms 11 are disposed in a way to face the top part of the shoulders or the front face of the chest or knees of the bather 6. A plurality of hot water showers having different spray patterns are sprayed from the plurality of nozzles provided at the tip of the nozzle arms 11 are sprayed on the shoulders, flanks, chest and abdomen portion of the bather from the front face either widely in a way to cover the entire areas or in concentrated way and pulsatingly on some specific portions. This enables to obtain comfortable, healthy and effective hot water shower bathing from the front and rear sides of body surface of the bather 6, with a combination of the first shower curtain 201 from the first wide-angle spray nozzle 8 and the second shower curtain 202 from the second wide-angle spray nozzle 9.

In this Exemplary Embodiment, the nozzles have a desired spray angle. However, the above described feature provides particularly excellent effects.

Exemplary Embodiment 6:

The basic construction of the water shower apparatus in Exemplary Embodiment 6 of the present invention has the same partial construction as that of Exemplary Embodiment 1. The explanation of illustration of that identical part will be omitted. In this Exemplary Embodiment, a plurality of spray nozzles are installed at the tip of the nozzle arm 11. The respective spray nozzles have different spray patterns. Those plurality of spray nozzles are connected to a piping through a nozzle header 13. The nozzle header 13 has at least one shape of cylindrical, spherical or semi-spherical shapes. Preferably no less than two nozzles with different specifications are installed. This makes it possible to spray hot water shower uniformly and effectively on the front face of the body surface of the bather 6. It is necessary to well take into account such factors as direction of nozzle, securing of spray area, artistic design suitable to the nozzle arm 11, design, working, piping assembling, quality, cost, etc. In this construction, the construction of the nozzle header 13 is maintained and the nozzles are disposed in a concentrated way.

Next, explanation will be given on motions and actions.

A plurality of hot water showers having different spray patterns and different spray angles are sprayed, from the nozzle header 13 provided at the tip of two nozzle arms 11 on the left and the right sides, on the front face of the bather uniformly and in concentrated way in a way to cover the entire areas of the shoulders, the flanks, the chest and the abdomen. Moreover, the first shower curtain 201 from the first wide-angle spray nozzle 8 and the second shower curtain 202 and the second wide-angle spray nozzle 9 are combined. This enables to obtain comfortable and effective hot water shower bathing from the front and the rear sides of body surface of the bather. Furthermore, the nozzle header 13 is constructed in small and compact size, and a plurality of nozzles are disposed in a concentrated way. This facilitates functioning of the nozzle arm 11, and provides a water shower apparatus of a design which does not give any feeling of malaise to the bather.

Exemplary Embodiment 7:

The basic construction of the water shower apparatus in Exemplary Embodiment 7 of the present invention has the same partial construction as that of Exemplary Embodiment 1. The explanation of illustration of that identical part will be omitted. In this Exemplary Embodiment, a plurality of spray nozzles are installed on the nozzle header 13. Those plurality of spray nozzles are disposed in the order having the spray patterns of the direct-jet spray nozzle 14, the slewing spray nozzle 15, and the wide-angle spray nozzle 16, from the tip of the nozzle header 13, i.e. downstream side of the hot water flow.

The smaller the spray angle, the larger the sprayed particles and the larger the thermal capacity. For that reason, even in the case of a long spraying distance up to contact with the skin, there is little drop of hot water temperature due to heat dissipation. Moreover, when the spray angle is large, the sprayed particles are small and the thermal capacity is also small. For that reason, there is a large drop of hot water temperature, when the spray angle is large and the spraying distance is long. In consideration of those characteristics, proper spray nozzles are disposed for the spray nozzles 14, 15, 16, depending on the distance from the arm to the respective portions of the skin.

The basic construction of the respective spray nozzles must have a flexible joint structure (structure of conventional art: not illustrated) composed of a spherical shaft capable of freely changing the spraying direction (not illustrated) and a spherical bearing (not illustrated). Various kinds of spray nozzles are installed in a small nozzle header 13. The conditions are required for spraying hot water shower to the front face of the lower half of the bather 6. Moreover, by connection and disconnection of nozzle nut, etc., it becomes possible to change the nozzle specifications, tighten the spray nozzles, and to also change the spray angle, etc.

Next, explanation will be given on the motions and actions.

The direct-jet spray nozzle 14, the slewing spray nozzle 15, and the wide-angle spray nozzle 16 are disposed in this order, from the tip of the nozzle header 13. This enables hot water bathing of the front face of the body of the bather 6. The direct-jet spray nozzle 14 directly sprays hot water shower in the form of a water gun to the knees and the feet which are farthest from the nozzle header 13.

The slewing spray nozzle 15 sprays hot water shower in the form of a whirl to the areas from the chest to the flanks and the abdomen. The whirl-shaped hot water shower gives a strong stimulus of pressing touch to the skin, to provide a massaging action. This promotes blood circulation.

The wide-angle spray nozzle 16, disposed at the position of shoulders, sprays hot water shower in a wide area. Moreover, a hot water shower curtain is sprayed to the shoulders, feet, hands, flanks and the chest. Generally, the shoulders, feet and hands are particularly difficult to warm, and get cool easily. Spraying of hot water shower curtain to the flanks and the chest promotes blood circulation. Thanks to this hot water shower curtain, cold air is shut off and heat is enclosed.

As described above, the warming action from the shower nozzle header 13 and the spray nozzle 19 is effectively utilized. Therefore, blood circulation can be promoted immediately after entry into a state of bathing. Furthermore, the bather can enjoy comfortable, healthy and refreshing hot water shower bathing.

Exemplary Embodiment 8:

The basic construction of the water shower apparatus in Exemplary Embodiment 8 of the present invention has the same partial construction as that of Exemplary Embodiment 1. The explanation of illustration of that identical part will be omitted. In this Exemplary Embodiment, as shown in the expanded view of main part in FIG. 9, a flexible joint means 12 is detachably installed between the nozzle arm 11 and the nozzle header 13. Or, the nozzle header 13 is rotatably installed around the axis of the nozzle arm 11, and the flexible joint means 12 is installed between the nozzle arm 11 and the nozzle header 13.

Next, explanation will be given on the motions and actions.

Since the nozzle arm 11 and the nozzle header 13 are detachably installed, the direction of spraying of the nozzles can be adjusted according to the breadth of shoulders of the bather 6. Therefore, a single unit of water shower apparatus can provide comfortable shower bathing to bathers with different breadths of shoulders, regardless of the dimension of breadth of shoulders of the bather 6. Moreover, the bather 6 can freely change the direction of spraying of hot water shower as desired. As a result, he can obtain highly satisfactory hot water shower bathing. Furthermore, it facilitates the maintenance work, etc. in case of troubles such as clogging of a plurality of nozzles provided on the nozzle header 13, etc.

Exemplary Embodiment 9:

The basic construction of the water shower apparatus in Exemplary Embodiment 9 of the present invention has the same partial construction as that of Exemplary Embodiment 1. The explanation of illustration of that identical part will be omitted. In this Exemplary Embodiment, the water shower apparatus is provided with a first curved nozzle arm 10, a front cover 17, and a third wide-angle spray nozzle 19. The first curved nozzle arm 10 enables the nozzle arm 11 to come out and withdraw. The front cover 17 is formed in a concave shape along the concave part of the curved first nozzle arm 10. The third wide-angle spray nozzle 19 is installed in the concave part 18 of the front cover 17.

Next, explanation will be given on the motions and actions.

The lower half portion of the main body 1 is narrow and, in addition, the lower half portion of the front cover 17 of the main body 1 is formed in a concave shape, along the concave curved portion of the telescopic first nozzle arm 10. This enables to obtain a water shower system of compact design. Moreover, an effective design is obtained also as artistic design. Furthermore, the lower part of a projection serves as a support to the waist. Still more, the hot water shower sprayed from the wide-angle spray nozzle 19 installed in the concave part of the main body spreads to left and right to a wide area of the back face of waist of the bather 6. This further promotes hot bathing action of the shower and provides comfortable shower bathing.

Exemplary Embodiment 10:

The basic construction of the water shower apparatus in Exemplary Embodiment 10 of the present invention has the same partial construction as that of Exemplary Embodiment 1. The explanation of illustration of that identical part will be omitted. In this Exemplary Embodiment, the dimension "A" at the top of the main body 1 is wider than the average breadth of shoulders "B" of adult bathers 6, and the dimension of width "C" at the bottom of the main body 1 is smaller than the average breadth of shoulders "B" of adult bathers 6. At about the center of the top of the main body 1 is installed a first wide-angle spray nozzle 8, and at about the left and right parts of the top of the main body 1 are installed second wide-angle spray nozzles 9.

Next, explanation will be given on the motions and actions.

A first hot water shower curtain 201 is sprayed horizontally from the first wide-angle spray nozzle 8 provided at about the center of the top of the main body 1. On the other hand, the second hot water shower curtain 202 in the form of thin film on the left and the right sprayed from the second wide-angle spray nozzles 9 provided at about the left and right parts of the top of the main body 1 covers the shoulders, flanks and the abdomen of the bather. Those shower curtains are sprayed uniformly and in concentrated way along the surface of the body of the bather 6. For that reason, the bather can enjoy comfortable shower bathing without feeling any "sense of cooling". Moreover, the main body 1 is realized in about a T shape narrower than the breadth of shoulders of the bather 6. The water shower apparatus is therefore small and compact generally. For that reason, the water shower apparatus does not give any feeling of malaise even if it is disposed on part of the wall face of the wash place in a narrow bathroom. Furthermore, the shower system is disposed neatly.

Exemplary Embodiment 11:

This Exemplary Embodiment indicates an example of concrete construction for putting to practical use a water shower apparatus having functions as described above.

Figure 10:
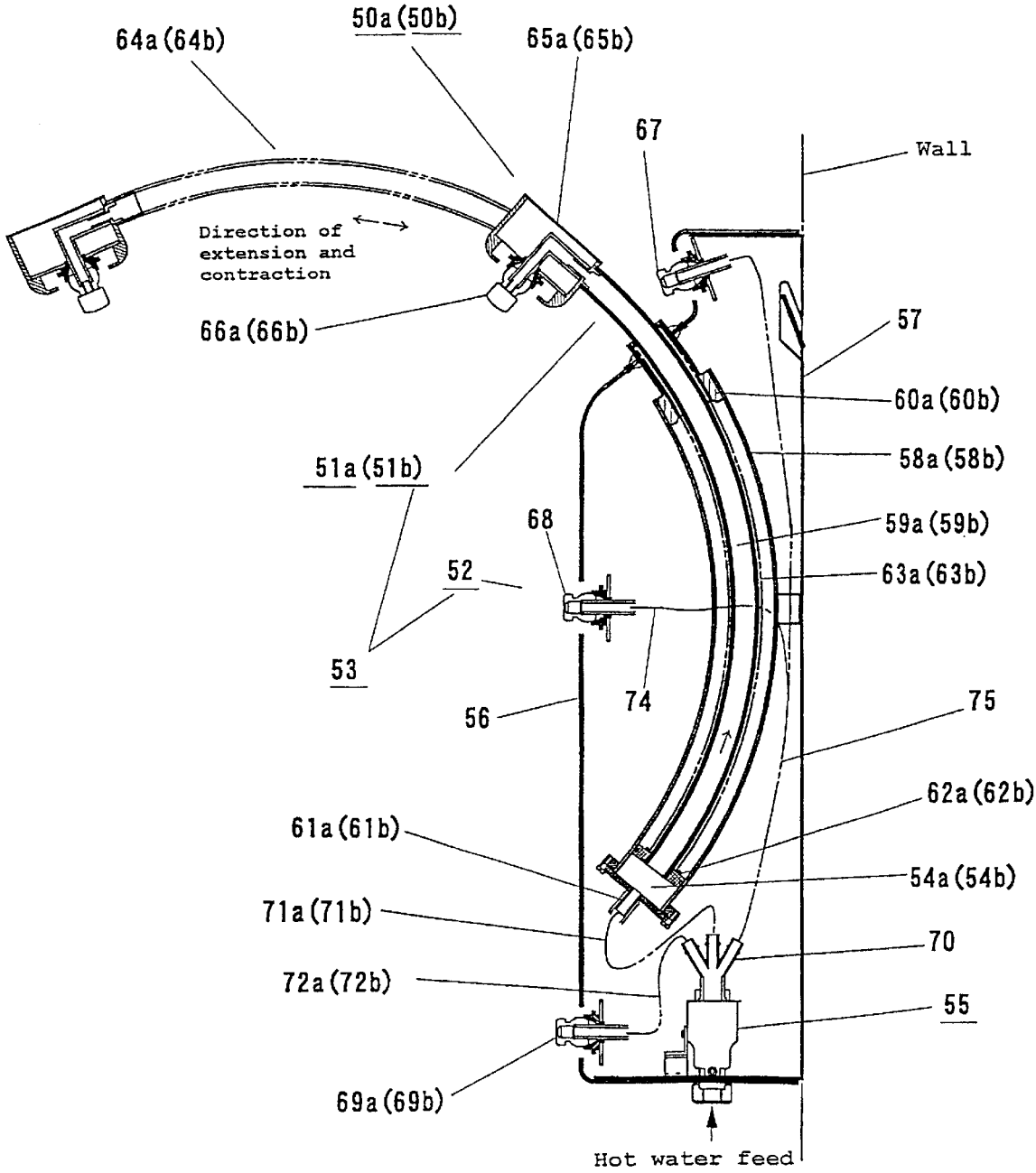
FIG. 10 is a side sectional view of the water shower apparatus in Embodiment 11 of the present invention.
Figure 11:
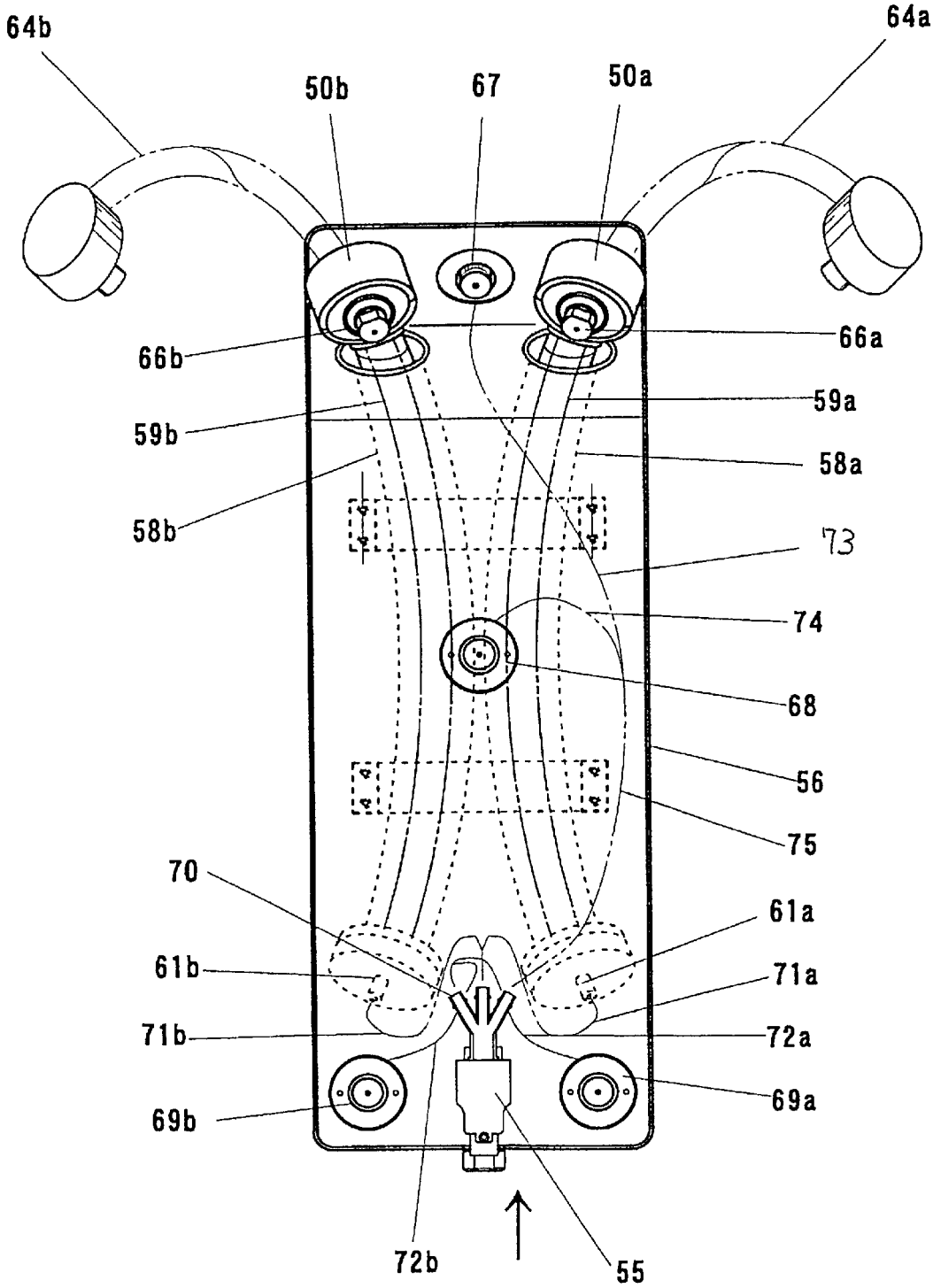
FIG. 11 is a front elevation of the water shower apparatus in Embodiment 11 of the present invention.

In FIG. 10 and FIG. 11, the water shower apparatus is provided with (a) telescopic arm means 51*a*, 51*b* at the tip of which are disposed shower nozzle heads 50*a*, 50*b*, (b) a compound shower means 53 composed of a shower means 52 on which are disposed a plurality of shower nozzles, (c) a driving means 54 for driving the arm of said telescopic arm means 51*a*, 51*b*, (d) a connecting means 55 for conducting mixed fluid of hot water and cold water to said compound shower means 53 through a hose from a combination faucet provided outside, (e) a front cover 56, and a back case 57.

FIG. 10 indicates a state in which the water shower apparatus is hung on the wall of the bathroom. The symbols "a", "b" indicate that the water shower apparatus is constructed by disposing the same parts symmetrically on the left and the right sides.

The telescopic arm means 51*a*, 51*b* are provided with fixed cylinders 58*a*, 58*b*, sliding arms 59*a*, 59*b*, slide checkers 60*a*, 60*b*, and sealed flanges 62*a*, 62*b*.

The fixed cylinders 58*a*, 58*b*, formed by placing arched pipes of different diameters one upon the other in the shape of a tube, correspond to the outer pipes. The sliding arms 59*a*, 59*b*, positioned on the inner pipes, move under the pressure of the fluid flowing into the fixed cylinders 58*a*, 58*b*. The slide checkers 60*a*, 60*b* are installed in the fixed cylinders 58*a*, 58*b*, to prevent the sliding arms 59*a*, 59*b* from sliding more than necessary. The sealed flanges 62*a*, 62*b*, fastened to the edge of the sliding arms 59*a*, 59*b*, control the fluid flowing from the cylinder inlets 61*a*, 61*b* to prevent it from leaking between the fixed cylinders 58*a*, 58*b* and sliding arms 59*a*, 59*b*, and drive the sliding arms 59*a*, 59*b* under the fluid pressure.

Between the slide checkers 60*a*, 60*b* and sealed flanges 62*a*, 62*b* are fastened springs 63*a*, 63*b*. Therefore, the driving means 64 is provided with sealed flanges 62*a*, 62*b*, subject to the fluid pressure, and springs 63*a*, 63*b*, disposed between the slide checkers 60*a*, 60*b* and sealed flanges 62*a*, 62*b*. Moreover, the shower nozzle heads 50*a*, 50*b* are provided with shower nozzles 66*a*, 66*b* loaded in the nozzle head covers 65*a*, 65*b*.

The telescopic arm means 51*a*, 51*b* are disposed face to face with each other in the direction in which the extending arms spread to outside from the extension outlet, as shown by the extension and contraction loci 64*a*, 64*b*. Moreover, the telescopic arm means 51*a*, 51*b* are disposed in inclined position, so that either the shower nozzle heads 50*a*, 50*b* or the shower nozzles 66*a*, 66*b* themselves may move along the locus of the extending arm, in the direction in which the shower moves in the 3-dimensional direction against the bather's body so as to wrap the bather's body.

The shower means 52 is provided with shower nozzles 67, 68, 69*a*, 69*b* disposed at fixed positions.

The fluid supply sources such as combination faucet, etc. are connected with either a connecting means or branching means 70, through hoses 71*a*, 72*a*, 72*b*, 73, 74, 75. This enables to supply fluid to the telescopic arm means 51*a*, 51*b* and the shower means 52.

Next, explanation will be given on the motions and actions.

The bather's body is seated with the back facing the front part of the water shower apparatus. The connecting means 55 of this shower system is connected through hose to a part of externally installed combination faucets or a connecting port of hand shower, for example. The fluid passes through the branching means 70, the tubes 71*a*, 71*b*, and the cylinder inlet ports 61*a*, 61*b*, to flow into the fixed cylinders 58*a*, 58*b*. The sliding arms 59*a*, 59*b* moving together with the sealed flanges 62*a*, 62*b* and in the shape of an arc are pushed up, under the fluid pressure exerted on the pressure receiving face of the sealed flanges 62*a*, 62*b* of the driving means 54. At the same time, the shower nozzle heads 50*a*, 50*b* also move in the front direction of the bather's body. As a result, the fluid which flew into the fixed cylinders 58*a*, 58*b* flows through the shower nozzle heads 50*a*, 50*b*, to be sprayed from the shower nozzles 66*a*, 66*b*.

In the case where the fluid from the combination faucet is stopped and the fluid flowing to the connecting means 55 stopped, the inflow into the fixed cylinders 58*a*, 58*b* stops. For that reason, no fluid pressure is exerted any longer on the sealed flanges 62*a*, 62*b* of the driving means 54. As a result, the telescopic arm means 51*a*, 51*b* are returned to be stored in the back case 57, under the restorative force of the springs 63*a*, 63*b*.

Preferably, the dead water draining means (not illustrated) disposed inside or outside the connecting means 55 is disposed between the telescopic arm means 51*a*, 51*b* and the combination faucet. In that case, when the flow of mixed fluid stopped, the dead water draining means works in response to the phenomenon of drop of the fluid pressure, and the fluid in the telescopic arm is discharged to outside. For that reason, the return of the sliding arms 59*a*, 59*b* by the restorative force of the springs 63*a*, 63*b* functions smoothly and speedily.

The path for extension and contraction of the arm extends and contracts two-dimensionally and in the shape of an arc. And, the telescopic arm means 51*a*, 51*b* are set in the direction in which the path of the extending arms 51*a*, 51*b* widens. Moreover, the shower nozzle heads 50*a*, 50*b* or the shower nozzles 66*a*, 66*b* themselves are provided in an inclined position. For that reason, the patterns of the shower are formed in the direction wrapping the bather's body. The direction of the shower is formed in the 3-dimensional directions against the bather's body, and the shower moves accordingly.

In the case where the arms 51*a*, 51*b* are disposed in a way to face each other, the shower is sprayed from both sides of the bather's body, and this widens the showering range wrapping the bather's body. Moreover, there is also a shower means 52 on which are disposed fixed shower nozzles. This makes it possible to spray shower on both the front face and the back face of the bather. Furthermore, when the shower stopped, the sliding arm of the telescopic arm means 51*a*, 51*b* is stored inside the main body. For that reason, a shower system non-obstructive in the bathroom is obtained. While the internal route of the telescopic arm means is formed in a way to let pass a fluid, this construction is not limitative, and the same effects as above can be obtained even with a construction in which the telescopic arm means has the function of extension and contraction only and a passage of fluid is provided separately.

Exemplary Embodiment 12:

This Exemplary Embodiment indicates an example of water shower apparatus provided with an electric telescopic arm means.

Figure 12:
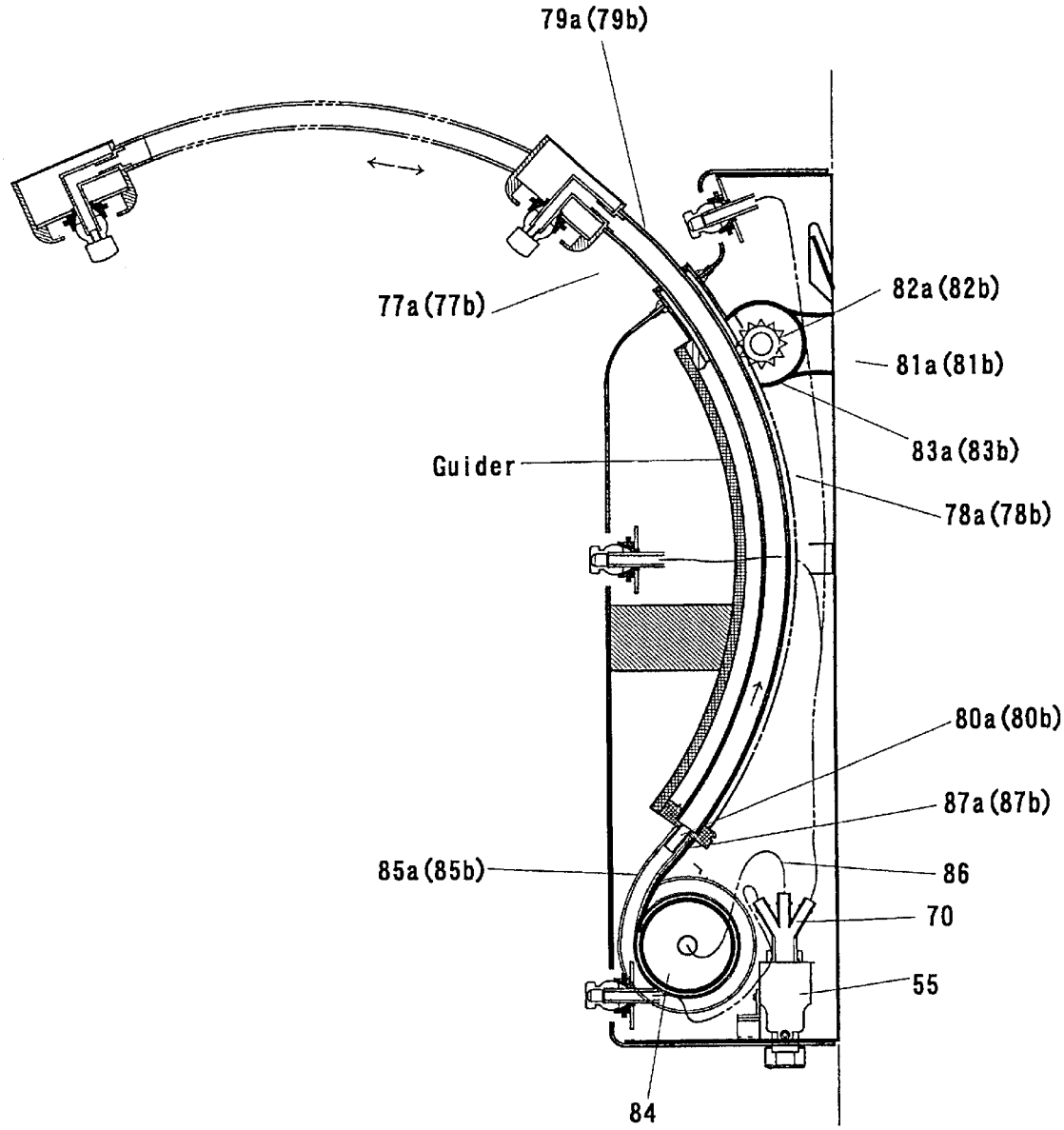
FIG. 12 is a side sectional view of the water shower apparatus in Embodiment 12 of the present invention.

In FIG. 12, the water shower apparatus is provided with telescopic arm means and driving means. The telescopic arm means has a gear turning shaft engaged with a feed rack provided on a sliding arm. The feed rack is made to move through said gear turning shaft, by utilizing the motive power of a motor such as AC motor, DC motor or stepping motor, etc. The arm comes out and withdraws in linkage with this movement. The driving means is formed this way. The construction of other parts is the same as that shown in FIG. 10, FIG. 11 of Exemplary Embodiment 11.

The components with same symbols as in FIG. 11, FIG. 12 have one same structure, and the explanation of their construction is omitted here.

The telescopic arm means 77*a*, 77*b* are provided with sliding arms 79*a*, 79*b* accompanied by feed racks 78*a*, 78*b*, shower nozzle heads 50*a*, 50*b* installed at an end of the sliding arms 79*a*, 79*b*, and inflow tubes 80*a*, 80*b* installed at the other end. The driving means 81*a*, 81*b* are provided with gear turning shafts 82*a*, 82*b* engaged with the feed racks 78*a*, 78*b*, and motors 83*a*, 83*b* installed for transmitting rotational force to the feed racks 78*a*, 78*b*. As motors 83*a*, 83*b*, it is desirable to use low-voltage motors such as AC motors, DC motors, stepping motors, etc.

Between the branch pipe 70 on the outlet side of the fluid supply means 55 and the inflow tubes 80*a*, 80*b* of the telescopic arm means 77*a*, 77*b* is disposed a hose reel means 84. The connection between the hose reel means 84 and the inflow tubes 80*a*, 80*b*, or between said hose reel means 84 and the branch pipe 70 is made with tubes 85*a*, 85*b* and tube 86. On the hose reel means 84 is disposed a take-up spring 87. With this arrangement, the hoses tubes 85*a*, 85*b* are taken up against the motive force of said driving means, or unwound, to make the arm extend or contract smoothly. This motion utilizes the take-up action by the restorative motive force of the spring.

The water shower apparatus is provided with a hose reel means 84. That reel is flexible and has a proper hardness to avoid crushing of hose on it. Moreover, it has a groove in spiral shape like that of a female screw, to prevent double winding and crushing of hose on the reel of the hose reel means 84. This enables smooth take-up and unwinding of the hose even during flowing of the fluid.

The telescopic arm means 77*a*, 77*b* are disposed symmetrically in a pair, as in Exemplary Embodiment 1 indicated in FIG. 1. The respective component parts constituting them are also disposed in pairs, and are numbered with "a" and "b" for identification of left and right parts.

The water shower apparatus in this Exemplary Embodiment 12 is provided with telescopic arm means 77*a*, 77*b*, combination shower means, driving means 81*a*, 81*b*, connecting means 55, a front cover 56, and a back case 57. The telescopic arm means 77*a*, 77*b* have shower nozzle heads 50*a*, 50*b* disposed at the tip of the arm. The combination shower means has a plurality of shower nozzles. The driving means 81*a*, 81*b* drive the telescopic arm means 77*a*, 77*b*.

In addition to the above construction, it is also possible to implement a construction in which a pair of telescopic arm means 77*a*, 77*b* are made move or stop at a time, with an operation of either one of the driving means 81*a* or 81*b*. Therefore, by operating either one of the driving means 81*a* or 81*b*, it is possible to either move to desired position or stop the shower nozzle heads 50*a*, 50*b*. In this state, the bather can receive shower.

Exemplary Embodiment 13:

The water shower apparatus in this Exemplary Embodiment is provided with other nozzle moving means.

Figure 13:
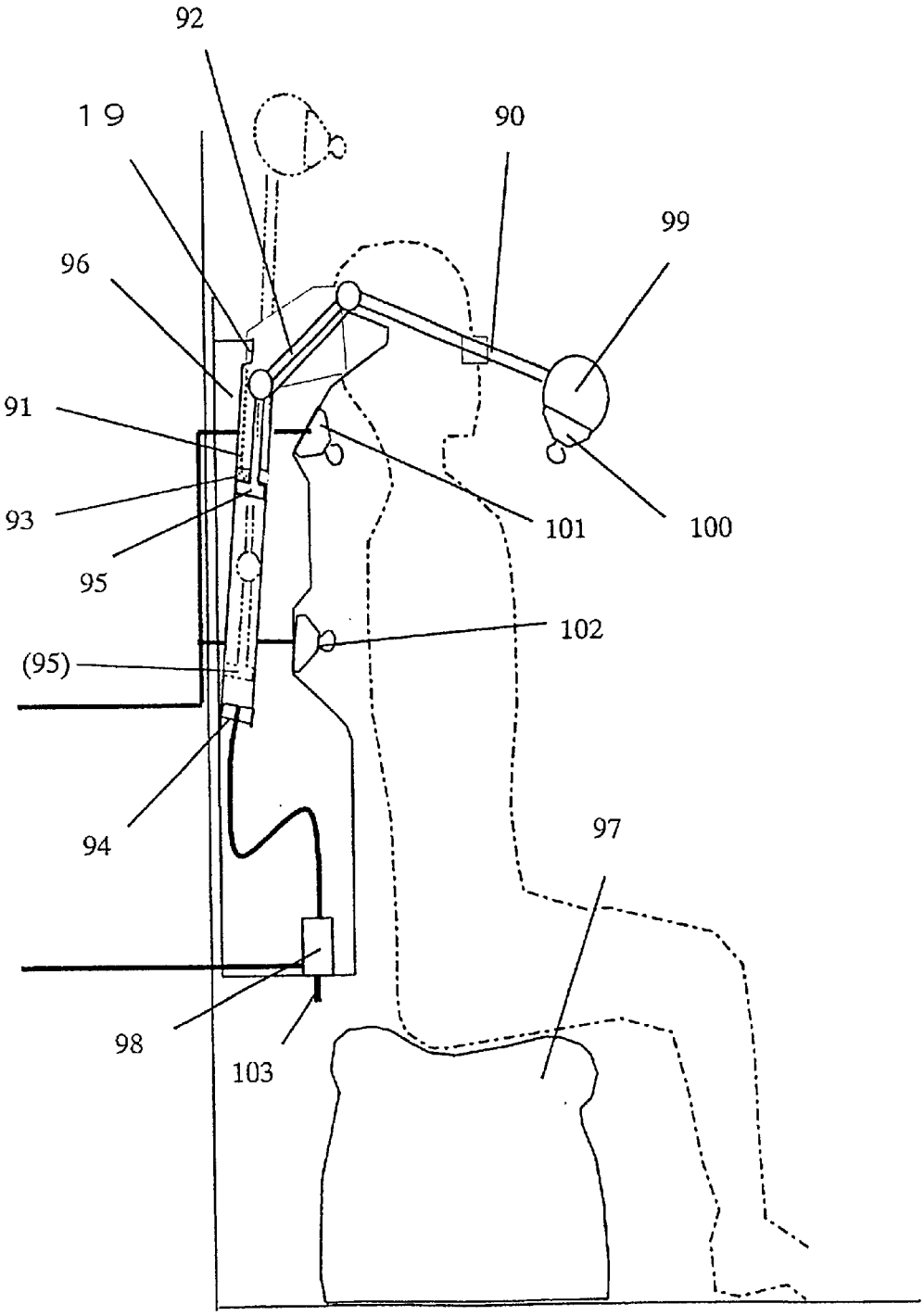
FIG. 13 is a side sectional view of the water shower apparatus in Embodiment 13 of the present invention.

In FIG. 13, the nozzle moving means 90 is provided with a fixed cylinder 91 and a sliding arm 92. The fixed cylinder 91 is formed by placing straight pipes of different diameters one upon the other in the shape of a tube, corresponds to the outer pipe. The sliding arm 92 corresponds to the inner pipe. The sliding arm 92 has a mobile part for bending on the way of the arm, and can be bent along the inflected fixed cylinder 91. In the fixed cylinder 91 is installed a slide checker 93 in which to install the sliding arm 92 and the sealed flange 95. The sliding arm 92 moves under the pressure of the fluid flowing into the fixed cylinder 91. The slide checker 93 prevents the sliding arm 92 from sliding more than necessary. The sealed flange 95 is fastened to the edge of the sliding arm 92. Moreover, the sealed flange 95 controls the fluid flowing from the cylinder inlet 94 to prevent it from leaking between the fixed cylinder 91 and the sliding arm 92. Furthermore, the sealed flange 95 drives the sliding arm 92 under the fluid pressure. In addition, between the slide checker 93 and the sealed flange 95 is fastened a spring.

Next, explanation will be given on the motions and actions.

The bather sits on the seating means 97, with his back turned to the front part of the main body 96 of the shower system. The fluid selecting means 98 is switched. Hot water flows through the fluid selecting means 98 and the cylinder inlet 94 into the fixed cylinder 91. The sliding arm 92 moving together with the sealed flange 95 and in the vertical direction is pushed up, under the fluid pressure exerted on the pressure receiving face of the sealed flange 95. Moreover, along the inflected fixed cylinder 91, the mobile part for bending of the sliding arm 92 is bent. At that time, the shower nozzle head 99 also moves in the front direction of the bather's body. As a result, the hot water which flew into the fixed cylinder 91 flows through the shower nozzle head 99, to be sprayed from the mobile shower nozzle 100 to the front face of the bather's body. At the same time, hot water is sprayed toward the back face of the bather's body, from the fixed shower nozzle 101 and the fixed shower nozzle 102. The shower is sprayed in a way to wrap the bather's body. Therefore, the bather can enjoy shower bathing in a relaxed way, with no need of turning his own body.

Moreover, the inflow of the hot water into the fixed cylinder 91 stops, when the fluid selecting means 98 is switched again, to let flow the hot water toward the drain port 103. This releases fluid pressure from the sealed flange 95. As a result, the nozzle moving means 90 is returned to be stored in the main body 96 of the shower system, under the restorative force of the spring. On the other hand, the hot water flowing through the drain port 103 flows out onto the wash place of the bathroom, for example. This provides heating for the floor by flowing hot water.

Exemplary Embodiment 14:

The water shower apparatus in this Exemplary Embodiment is provided with still other nozzle moving means.

Figure 14:
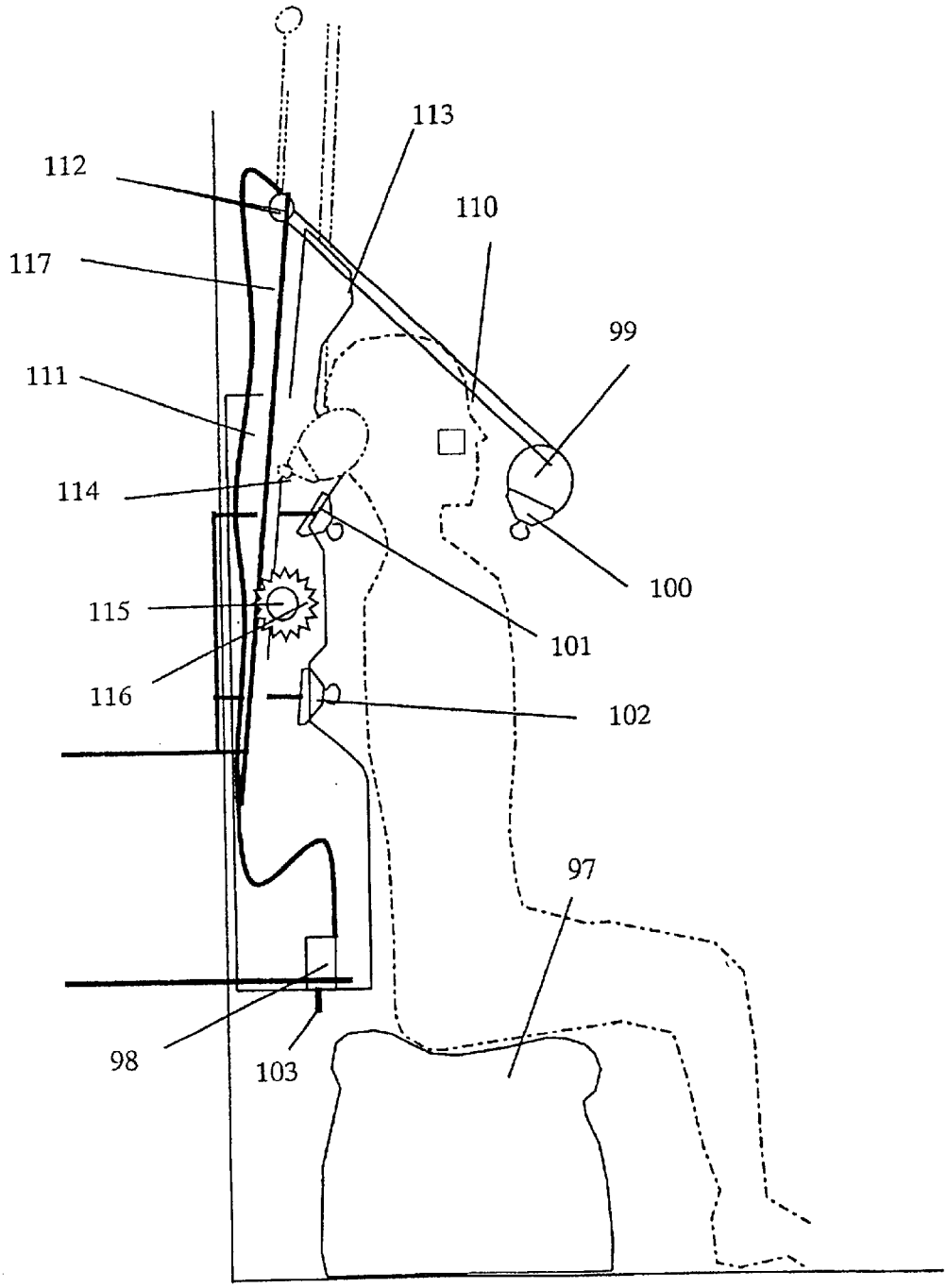
FIG. 14 is a side sectional view of the water shower apparatus in Embodiment 14 of the present invention.

In FIG. 14, the nozzle moving means 110 is provided with a nozzle arm 113, a feed rack 114, a gear 115, and an electric motor 116.

The nozzle arm 113 is supported on the main body 111 by a rotational joint 112. The feed rack 114 moves the rotational joint 112 in the up-down direction. The gear 115 drives the feed rack 114. The electric motor 116 transmits rotational force to the gear 115. As electric motor 116, it is desirable to use low-voltage motors such as AC motors, DC motors, stepping motors, etc. The nozzle arm 113 is hollow. A hose 117 passes through the inside of the nozzle arm 113. The hose 117 provides communication among the shower nozzle head 99, the mobile shower nozzle 100 and the fluid selecting means 98.

In this Exemplary Embodiment, the components with same symbols as in FIG. 13 have one same structure, and the explanation of such components is omitted here.

Next, explanation will be given on the motions and actions.

The bather sits on the seating means 97, with his back turned to the front part of the main body 111 of the water shower apparatus. The electric motor 116 starts working. With its rotational motive force, the feed rack 114 moves through the gear 115. The rotational joint 112 positioned over the main body 111 of the shower system moves downward. When rotational joint 112 positioned over the main body 111 of the shower system came down to near the top end of the main body 111, the nozzle arm 113 tilts, because of the shape at the top end of the main body 111, and the shower nozzle head 99 also moves toward the front face of the bather's body. As the fluid selecting means 98 is switched, the hot water passes through the fluid selecting means 98 and the hose 117, toward the shower nozzle head 99. Hot water is sprayed from the mobile shower nozzle 100 to the front face of the bather's body. At the same time, hot water is sprayed toward the back face of the bather's body, from the fixed shower nozzle 101 and the fixed shower nozzle 102. This enables to spray shower in a way to wrap the bather's body. The bather can therefore enjoy shower bathing in a relaxed way, with no need of turning his own body.

In this Exemplary Embodiment, the nozzle moving means is formed in a way to let pass the fluid through the internal passage of the nozzle moving means, but this construction is not limitative, and it is also possible to implement a construction in which the nozzle moving means has the function of extension and contraction only and a passage of fluid is provided separately. The same effects as above can be obtained even with such construction.

Exemplary Embodiment 15:

The water shower apparatus in this Exemplary Embodiment is provided with still other nozzle moving means.

Figure 15:
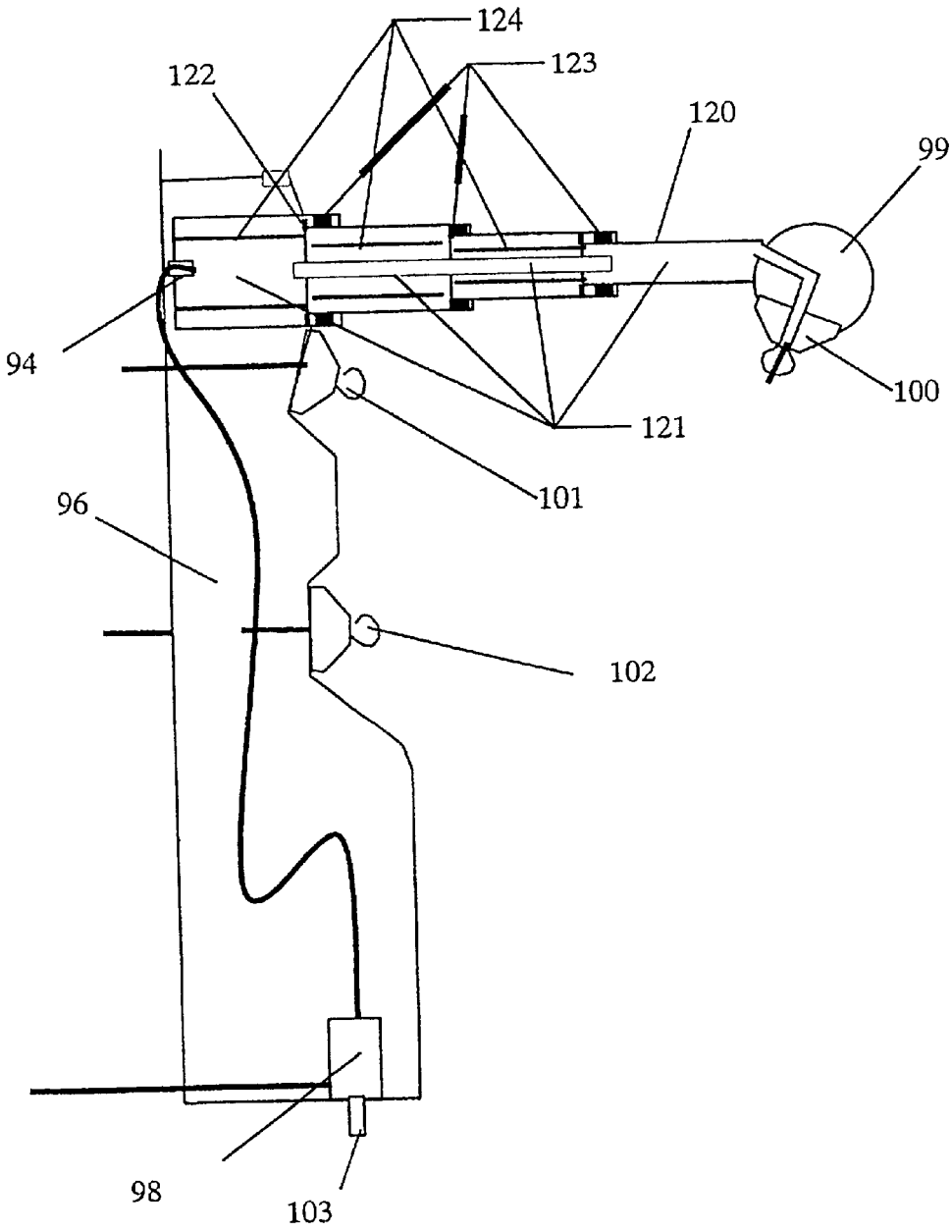
FIG. 15 is a side sectional view of the water shower apparatus in Embodiment 15 of the present invention.
Figure 16:
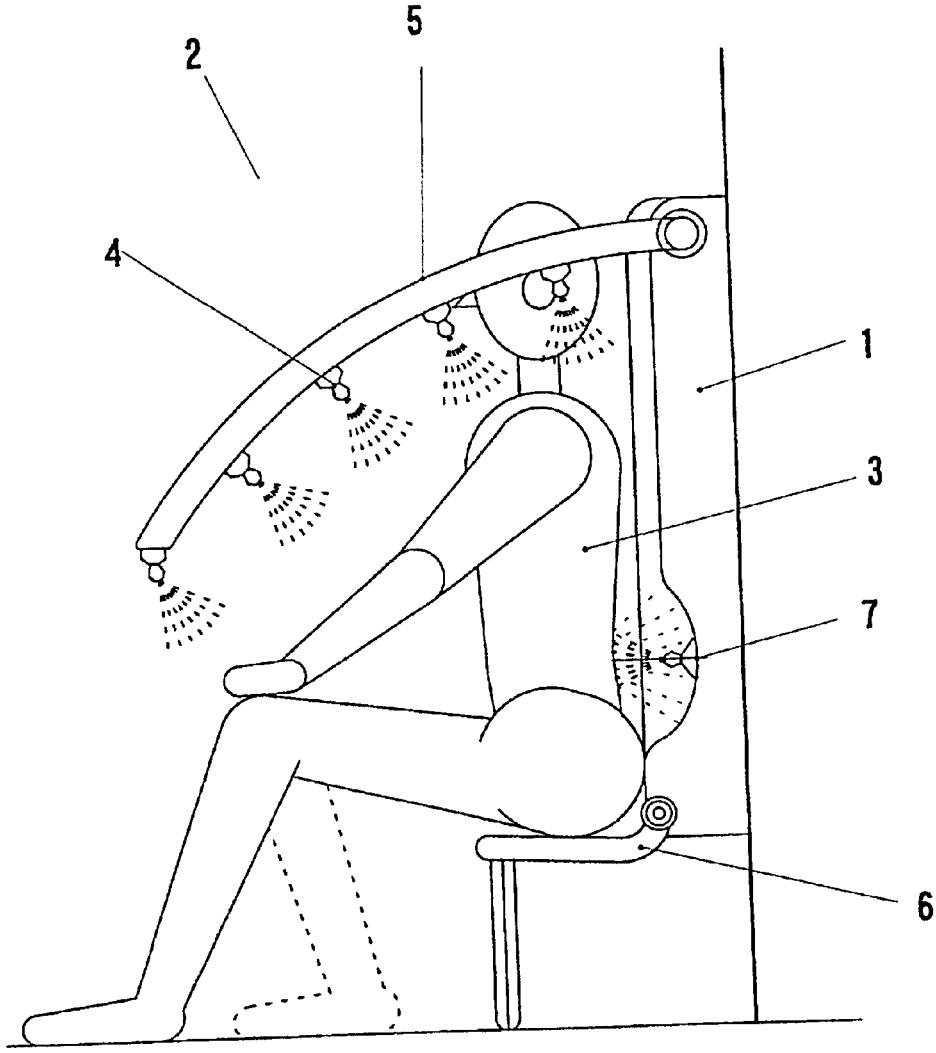
Fig. 16 PRIOR ART
FIG. 16 is an external side view of a conventional water shower apparatus.

In FIG. 15, the nozzle moving means 120 is provided with a slide checker 122 and sealed portions 123.

The slide checker 122, formed by placing four straight pipes 121 of different diameters one upon another, is installed at the end of the respective pipes. The slide checker 122 prevents the pipe 121 from sliding more than necessary. The sealed portions 123 are installed by being fastened to the end of the respective pipes 121. The sealed portions 123 prevent the fluid, flowing from the cylinder inlet 94, from leaking between the gap among the pipes placed one upon another. Furthermore, the respective pipes are connected to one another by means of spring 124. The shower nozzle head 99 or the mobile shower nozzle 100 themselves are disposed, so that the shower may be sprayed in the direction in which to wrap the bather's body along the path of the extending arm.

In this Exemplary Embodiment, the components with same symbols as in FIG. 13 have one same structure as that in FIG. 13, and the explanation of such components is omitted here.

Next, explanation will be given on the motions and actions.

The bather sits on the seating means 97, with his back turned to the front part of the main body 96 of the shower system. The fluid selecting means 98 is switched, and the hot water passes through the fluid selecting means 98 and the cylinder inlet 94, toward the outermost tube of the pipe 121. At that time, the end face of the next outer tube of the pipe 121 becomes the pressure receiving face and, as the next outer tube of the pipe 121 is pushed up under the fluid pressure, hot water flows into the third outer tube of the pipe 121. The third outer tube of the pipe 121 becomes the pressure receiving face and, as the third outer tube of the pipe 121 is pushed up under the fluid pressure, hot water flows into the third outer tube of the pipe 121. This motion is repeated, and the shower nozzle head 99 provided by fixing in the innermost tube moves toward the front face of the bather's body. This enables the hot water which flew into the respective pipes 121 to pass toward the shower nozzle head 99, to be sprayed to the front face of the bather's body from the mobile shower nozzle 100. At the same time, hot water is sprayed toward the back face of the bather's body, from the fixed shower nozzle 101 and the fixed shower nozzle 102. This enables to spray shower in a way to wrap the bather's body. Therefore, the bather can enjoy shower bathing in a relaxed way, with no need of turning his own body.

When the fluid selecting means 14 is switched again, to let flow the hot water toward the drain port 103, the inflow of the hot water stops and the fluid pressure is released from the end face of the respective pipes 121. As a result, the nozzle moving means 120 is returned to be stored in the main body 96 of the shower system, under the restorative force of the spring 124. On the other hand, the hot water flowing through the drain port 103 flows out onto the wash place of the bathroom, for example. For that reason, this hot water can be utilized for the purpose of heating the floor with flowing hot water. While the nozzle moving means is formed in a way to let pass the fluid through the internal passage of the nozzle moving means, this construction is not limitative, and it is also possible to implement a construction in which the nozzle moving means has the function of extension and contraction only and a passage of fluid is provided separately. The same effects as above can be obtained even with such construction.

As described above, the construction of the invention provides (a) a cold air intercepting action by air curtain, (b) a hot air controlling action for holding the hot air rising inside, (c) a warming action by direct touch of sprayed hot water with the skin, and (d) a warming action obtained in the course of flowing down of hot water through the surface of the skin after being sprayed on it. By those actions, it becomes possible to protect about the entire body of the bather including the lower half and the side faces against a "sense of cooling". As a result, a warm hot air shower can be realized, and the bather can enjoy comfortable shower bathing.

What is claimed is:

1. A water shower apparatus comprising:

a main body positioned behind a back of a bather, the main body having a concave-shaped front cover, with a concave shape, said concave shape extending verticaiiy along said main body, a plurality of arms supported movably on said main body, and spray nozzle on each of said arms for spraying water, wherein said arms are movable towards and away from each other, and a width of positions where said arms are supported by said main body is narrower than a breadth of shoulders of the bather.

2. The water shower apparatus according to claim 1, wherein each of said arms has a curved shape.

3. The water shower apparatus according to claim 1 wherein said arms are received at the main body in narrower area than a breadth of shoulders of the bather and are movable to a position wider than the breadth of the shoulders when in use.

4. The water shower apparatus according to claim 1 wherein each of said arms has a plurality of the spray nozzles, and respective spray nozzles of said each arms have different spraying patterns.

5. The water shower apparatus according to claim 4 wherein the spray nozzles have a first spray nozzle spraying in the area from about the knee to the feet of said bather, a second spray nozzle spraying in the area from about the abdomen to the chest of said bather, and a third spray nozzle spraying toward about the shoulders of said bather.

6. The water shower apparatus according to claim 4 wherein when the spraying angle of said first spray nozzle is "C", the spraying angle of said second spray nozzle is "D", and the spraying angle of said third spray nozzle is "E", the spraying angles of said respective spray nozzles are in the relation of $C<D<E$.

7. The water shower apparatus according to claim 4 wherein said plurality of spray nozzles have at least one selected from the group consisting of a direct spray nozzle, a fan-shaped spray nozzle having a small spray angle, a slewing spray nozzle, and a wide-angle spray nozzle.

8. A water shower apparatus according to claim 1 wherein circumference of said concave shape extends vertically along said main body.

* * * * *

UNITED STATES PATENT AND TRADEMARK OFFICE

CERTIFICATE OF CORRECTION

PATENT NO. : 6,920,654 B2
APPLICATION NO. : 09/894704
DATED : July 26, 2005
INVENTOR(S) : Masao Noguchi et al.

It is certified that error appears in the above-identified patent and that said Letters Patent is hereby corrected as shown below:

Column 26, Line 12, Claim 6

"4" should read -- 5 --.

Signed and Sealed this

Twenty-seventh Day of November, 2007

JON W. DUDAS
*Director of the United States Patent and Trademark Office*